US006143452A

United States Patent [19]

Sakimura et al.

[11] Patent Number: 6,143,452

[45] Date of Patent: Nov. 7, 2000

[54] ELECTROPHOTOGRAPHIC PHOTORECEPTOR

[75] Inventors: Tomoo Sakimura; Akihiko Itami, both of Hachioji; Kazumasa Watanabe, Hino; Shingo Fujimoto, Hino; Toyoko Shibata, Hino; Tomoko Sakimura, Hino, all of Japan

[73] Assignee: Konica Corporation

[21] Appl. No.: 09/395,829

[22] Filed: Sep. 14, 1999

[30] Foreign Application Priority Data

| | | | |
|---|---|---|---|
| Sep. 29, 1998 | [JP] | Japan | 10-275245 |
| Mar. 16, 1999 | [JP] | Japan | 11-070308 |
| Jul. 21, 1999 | [JP] | Japan | 11-206189 |

[51] Int. Cl.[7] ..... G03G 5/047

[52] U.S. Cl. ..... 430/58.2; 430/132

[58] Field of Search ..... 430/58.2, 132

[56] References Cited

U.S. PATENT DOCUMENTS

| | | | |
|---|---|---|---|
| 5,230,976 | 7/1993 | Schank et al. | 430/58.2 |
| 5,688,961 | 11/1997 | Kushibiki et al. | 430/58.2 |
| 5,830,972 | 11/1998 | Ueda et al. | 430/58.2 |

*Primary Examiner*—Roland Martin

*Attorney, Agent, or Firm*—Jordan B. Bierman; Bierman, Muserlian and Lucas

[57] ABSTRACT

An electrophotographic photoreceptor characterized in comprising a resin layer containing a hardenable siloxane-based resin having a partial structure described below:

wherein X represents a charge transportability providing group, which is a group bonding to Y in the formula via a carbon atom constituting said providing group, and Y represents at least a bivalent atom or group, excluding adjacent bonding atoms.

41 Claims, 1 Drawing Sheet

ELECTROPHOTOGRAPHIC PHOTORECEPTOR

BACKGROUND OF THE INVENTION

The present invention relates to an electrophotographic photoreceptor and a production method of the same, as well as a process cartridge and an image forming apparatus in which said photoreceptor is installed.

In recent years, as electrophotographic photoreceptors, those which comprise organic photoconductive materials have been widely employed. The organic photoreceptors exhibit more advantageous features than other photoreceptors in such a manner that the materials corresponding to various exposure light sources ranging from visible light to infrared light tend to be developed, materials which do not result in environmental pollution can be chosen, and the production cost is relatively low. The only disadvantage is that the mechanical strength is not sufficiently high, and during copying or printing of a number of sheets, the surface of the photoreceptor results in wear and abrasion.

The surface of electrophotographic photoreceptors is subjected to direct application of electrical and mechanical external forces from a charging unit, a development unit, a transfer means, a cleaning unit, and the like. Therefore, durability is required to counter these external forces. Specifically, sufficient durability is required to counter the generation of wear and abrasion due to sliding friction on the photoreceptor surface, and degradation of the photoreceptor surface due to ozone and active oxygen generated during corona discharge.

In order to satisfy the various properties mentioned above which are required for the photoreceptor surface, various factors have been investigated. Namely, it is reported that by employing BPZ polycarbonate as a binder (a binding resin) on the photoreceptor surface, surface wear properties as well as toner filming properties are enhanced. Furthermore, Japanese Patent Publication Open to Public Inspection No. 6-118681 discloses a hardenable silicone resin containing colloidal silica, which is employed as a photoreceptor surface protecting layer.

However, the photoreceptor in which the BPZ polycarbonate binder is employed exhibits insufficient wear resistant properties and exhibits insufficient durability. On the other hand, the surface layer comprised of the hardenable silicone resin containing colloidal silica exhibits improved wear resistant properties, however, during repeated use, electrophotographic properties are insufficient and tend to result in background staining, as well as image blurring and sufficient durability is not achieved.

As a method to solve such problems, Japanese Patent Publication Open to Public Inspection Nos. 9-124943 and 9-190004 propose photoreceptors, having as a surface layer, the layer of a resin prepared by bonding an organic silicone-modified positive hole transportable compound to hardenable organic silicone based high polymer molecules. However, this resin layer results in background staining as well as image blurring at high humidity, and also exhibits insufficient durability.

SUMMARY OF THE INVENTION

An object of the present invention is to develop an electrophotographic photoreceptor which exhibits high surface hardness, excellent wear resistance, and stable electrophotographic properties during repeated use at high temperature and humidity, accordingly results in excellent images during repeated use so that the above-mentioned problems can be solved, and a production method of the same, and to further provide a process cartridge and an image forming apparatus employing said photoreceptor.

The inventors of the present invention have exerted their best effort. As a result, it was found that the object of the present invention had been accomplished by employing any of the embodiments described below.

1. An electrophotographic photoreceptor characterized in comprising a resin layer containing a hardenable siloxane based resin.

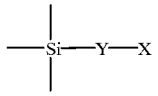

wherein X represents a charge transportability providing group, that is, a group which bonds to Y in the formula via a carbon atom which constitutes said providing group, and Y represents two or more valent group removing bonding atoms (Si and C) adjacent to Y.

2. An electrophotographic photoreceptor characterized in comprising a resin layer containing a hardenable siloxane based resin having the partial structure described below:

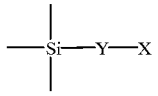

wherein X represents a charge transportability providing group, that is, a group which bonds to Y in the formula via a carbon atom which constitutes said providing group, and Y represents O, S, and NR, wherein R represents H or a univalent organic group.

3. An electrophotographic photoreceptor characterized in comprising a resin layer containing a hardenable siloxane based resin prepared by reacting an organic silicon compound having a hydroxyl group or a hydrolizable group with a charge transport compound having hydroxy group.

4. An electrophotographic photoreceptor characterized in comprising a resin layer containing a hardenable siloxane based resin prepared by reacting an organic silicon compound having a hydroxyl group or a hydrolizable group with a charge transport compound having an amino group.

5. An electrophotographic photoreceptor characterized in comprising a resin layer containing a hardenable siloxane based resin prepared by reacting an organic silicon compound having a hydroxyl group or hydrolizable group with a charge transport compound having a mercapto group.

6. The electrophotographic photoreceptor described in any one of items 1 through 5 above characterized in that said resin layer containing the siloxane based resin is hardened.

7. The electrophotographic photoreceptor described in any one of items 1 through 6 above characterized in that said resin layer is a surface layer.

8. The electrophotographic photoreceptor described in item 7 above characterized in comprising a charge generating layer and a charge transport layer under said surface layer.

9. The electrophotographic photoreceptor described in item 7 above characterized in comprising a charge generating and transport layer.

10. The electrophotographic photoreceptor described in items 7 or 8 above characterized in comprising an electrically conductive support having thereon an interlayer, thereon a charge generating layer, and further thereon a charge transport layer.

11. The electrophotographic photoreceptor described in any one of items 7 through 10 above characterized in that the thickness of said surface layer is 0.1 to 20 $\mu$m.

12. The electrophotographic photoreceptor described in any one of items 7 through 11 above characterized in that an adhesive layer is provided between the surface layer and a layer adjacent to said surface layer.

13. The electrophotographic photoreceptor described in any one of items 1, 2, and 6 through 12 above characterized in that said charge transportability providing group is a triarylamine based compound group.

14. The electrophotographic photoreceptor described in any one of items 1, 2, and 6 through 12 above characterized in that said charge transportability providing group is a hydrazine based compound group.

15. The electrophotographic photoreceptor described in any one of items 1, 2, and 6 through 12 above characterized in that said charge transportability providing group is a styryltriphenylamine based compound group.

16. The electrophotographic photoreceptor described in any one of items 1, 2, and 6 through 12 above characterized in that said charge transportability providing group is a benzidine based compound group.

17. The electrophotographic photoreceptor described in any one of items 1, 2, 6 through 12 above characterized in that said charge transportability providing group is a butadiene based compound group.

18. In an image forming apparatus in which employing an electrophotographic photoreceptor, image formation is carried out through charging, image exposure, development, transfer, separation and cleaning processes, an electrophotographic image forming apparatus characterized in that the electrophotographic photoreceptor described in any one of items 1 through 17 above is employed as said electrophotographic photoreceptor.

19. In a process cartridge employed in an image forming apparatus in which employing an electrophotographic photoreceptor, image forming is carried out through charging, image exposure, development, transfer, separation and cleaning processes, a process cartridge characterized in being produced by combining the electrophotographic photoreceptor described in any one of items 1 through 17 above with at least one of a charging unit, an image exposure unit, a development unit, a transfer or separation unit, or a cleaning unit.

20. A production method of an electrophotographic photoreceptor characterized in that applied onto an electrically conductive support is a resin layer comprising a hardenable siloxane based resin prepared by reacting an organic silicon compound having a hydroxyl group or a hydrolizable group with a charge transport compound having a hydroxyl group, and thereafter the resulting coating is hardened at a temperature above 50° C.

21. A production method of an electrophotographic photoreceptor characterized in that onto an electrically conductive support, applied is a resin layer comprising a hardenable siloxane based resin prepared by reacting an organic silicon compound having a hydroxyl group or hydrolizable group with a charge transport compound having an amino group, and thereafter, the resulting coating is hardened at a temperature above 50° C.

22. A production method of an electrophotographic photoreceptor characterized in that applied onto an electrically conductive support is a resin layer comprising a hardenable siloxane based resin prepared by reacting an organic silicon compound having a hydroxyl group or a hydrolizable group with a charge transportable compound having an mercapto group, and thereafter, the resulting coating is hardened at a temperature above 50° C.

DETAILED DESCRIPTION OF THE INVENTION

Figure 1:
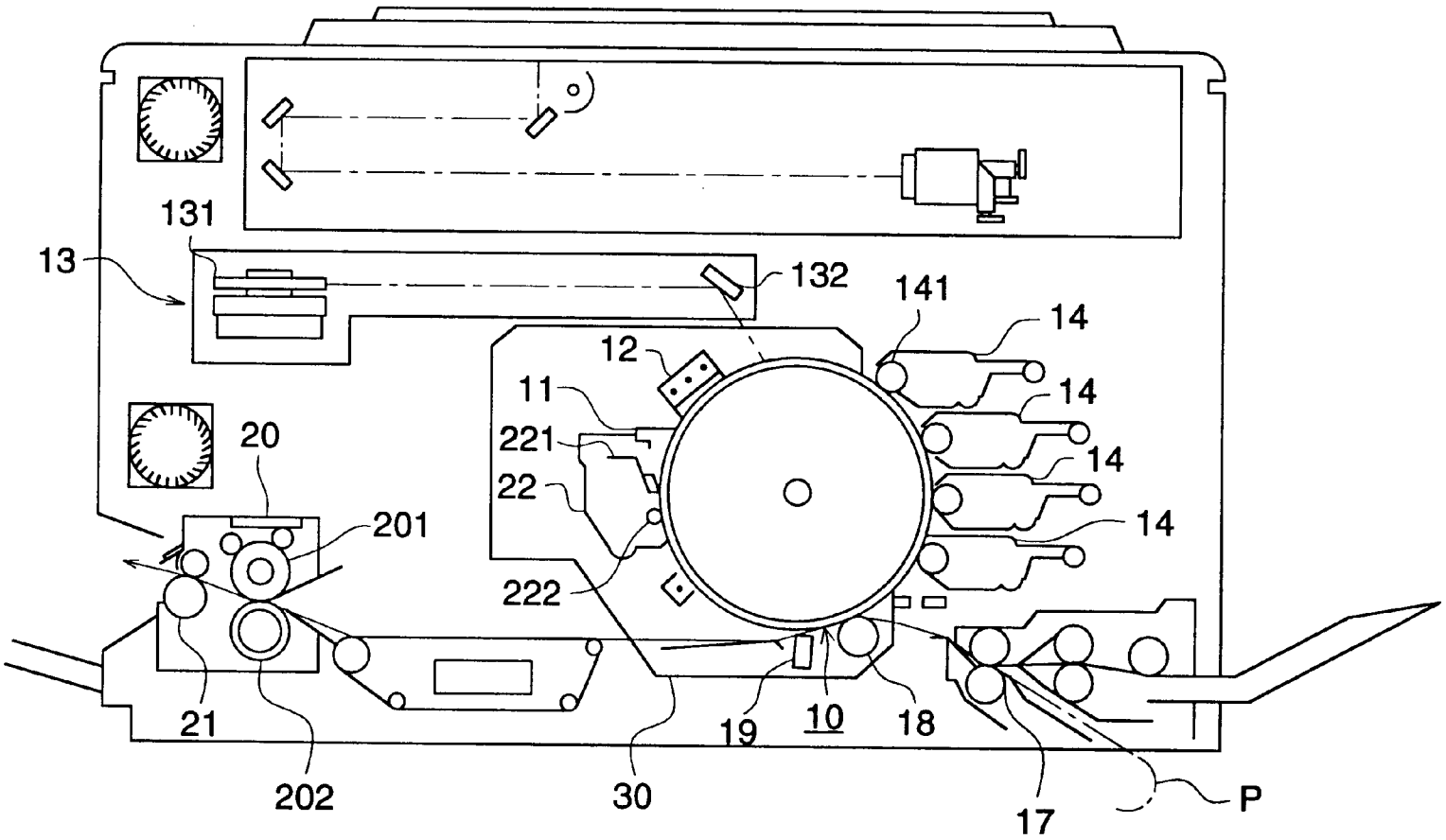
FIG. 1 is a cross-sectional view of an image forming apparatus comprising the photoreceptor of the present invention.

The present invention will be further described.

In the present invention, the charge transportability providing group as described herein denotes a group which contains the structure of a commonly employed charge transport material (hereinafter referred to as CTM or a charge transportable compound) and bonds to Y in the formula via the carbon atom constituting said charge transportable compound or one carbon atom of a compound containing said charge transportable compound as the partial structure.

Namely, listed as the representatives are groups having structures of practiced charge transport compounds, for example, structures of triarylamine derivatives such as oxazole derivatives, oxadiazole derivatives, imidazole derivatives, triphenylamines, and the like, 9-(p-diethylaminostyryl)anthracene, 1,1-bis-(4-dibenzylaminophenol)propane, styrylanthracene, styrylpyrazoline, phenylhydrazones, $\alpha$-phenylstilbene derivatives, thiazole derivatives, triazole derivatives, phenazine derivatives, acridine derivatives, benzofuran derivatives, benzimidazole derivatives, thiophene derivatives, N-phenylcarbazole derivatives, and those groups which bond to Y in the formula described below via a carbon atom constituting said compounds or one carbon atom of a compound containing said charge transport material, as a partial structure.

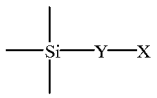

wherein X represents a charge transportability providing group, which bonds to Y in the formula via a carbon atom constituting said providing group, and Y represents a divalent or higher valent atom excluding bonding atoms (Si and C) adjacent to Y.

The charge transportability providing group X is illustrated as a univalent group in the above formula. However, when the charge transportable compound comprises at least two reactive functional groups, in a siloxane based resin, a bond may be formed as a divalent or higher valent crosslinking group, or merely as a pendant group. Herein Y may be any atom, except divalent or higher valent bonding atoms (such as a silicon atom (Si) and a carbon atom (C)). However, when Y represents a trivalent or higher valent atom, the bonding terminal of Y, except Si and C in the above formula, may bond to any constituting atom in the above-mentioned siloxane based resin which is capable of bonding, or may have a structure which is subjected to bonding with the other atom or molecular group. Preferred as the above-mentioned divalent or higher valent atoms are specifically an oxygen atom (O), a sulfur atom (S), and a nitrogen atom (N).

The above-mentioned atoms, that is, O, S, and N atoms, are formed through the reaction of a hydroxyl group, a mercapto group, or an amine group introduced into a compound having a charge transport function, respectively with an organic silicon compound having a hydroxyl group or a hydrolizable group, and it is possible to form a resin layer comprising a hardenable siloxane based resin having the partial structure described below:

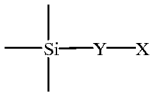

wherein X represents a charge transportability providing group which bonds to Y in the formula via a carbon atom constituting said providing group, Y represents O, S, and NR, and R represents H and a univalent organic group.

The hardenable siloxane resins as described in the present invention denote resins prepared by forming a three-dimensional net structure through allowing monomers, oligomers, and polymers previously having a siloxane bond in the chemical structure unit to react (as in a hydrolysis reaction, including reactions in which a catalyst and a crosslinking agent are added, and the like) followed by hardening. Generally, the siloxane resins are those prepared in such a manner that an organic silicon compound having a siloxane bond is subjected to hydrolysis followed by dehydration condensation to enhance the siloxane bonding and then to form the three dimensional net structure. For example, the siloxane resins means those in which the three dimensional structure is formed through the condensation of compositions comprised of alkoxysilane or compositions comprised of alkoxysilane and colloidal silica.

Generally employed as raw materials of the above-mentioned hardenable siloxane based resins are organic silicone compounds having a hydroxyl group or a hydrolizable group. The above-mentioned hydrolizable groups as described herein include a methoxy group, an ethoxy group, a methylethylketoxime group, a diethylamino group, an acetoxy group, a propenoxy group, propoxy group, a butoxy group, a methoxyethoxy group, or the like. Of these, an alkoxy group having from 1 to 6 carbon atoms is preferred.

In the organic silicone compounds employed as raw materials for the hardenable siloxane based resins in the present invention, when the number n of hydrolizable groups is 1, the polymerization reaction of the organic silicone compound is generally retarded. When n is 2, 3 or 4, the polymerization reaction tends to occur, and specifically, when n is 3 or 4, it is possible to highly conduct crosslinking reactions. Accordingly, by controlling these, the stability of the resulting coating layer composition, the hardness of the resin layer after coating, and the like may also be controlled.

The preferred composition ratio of the above-mentioned siloxane based resin is that the component (B component) having an n of 3 or 4 is employed in an amount of 0.05 to 1 mole per mole of the component (A component) having an n of 1 or 2. Furthermore, it is preferred that 1 to 100 parts by weight of the component (component C) of charge transportable compound group having a hydroxyl group, a mercapto group or an amine group which react with the above-mentioned organic silicone compound to from a resin layer, is preferably employed for 100 parts by weight of the total amount of the above-mentioned siloxane component. When the above-mentioned component A is employed and is out of the above-mentioned range, specifically being below the limit, the resulting siloxane resin layer results in insufficient hardness due to insufficient crosslinking density. Furthermore, in the case an excessive amount of the component A, excessively high crosslinking density results in sufficient harness with a brittle resin layer. In the case of a small amount of the component C, the resulting siloxane resin layer results in decreased sensitivity and also in residual potential rise due to minimal charge transportability, while in the case of an excessive amount of the component C, it is found that the layer strength of the siloxane resin layer tends to be weakened.

Furthermore, employed as the raw materials for the above-mentioned siloxane based resins may be hydrolysis condensation products prepared by hydrolyzing the above-mentioned organic silicon compounds under acidic or basic conditions to form oligomer.

Next, the charge transportable compounds having a hydroxyl group, a mercapto group, and an amine group, employed in the present invention, will be described.

The charge transportable compounds having a hydroxyl group as described herein are those having commonly employed structures, and in addition, also compounds having a hydroxyl group. Namely, representatively listed can be the charge transportable compounds represented by the general formula shown below, which bond to siloxane based organic silicon compounds and are capable of forming a resin layer. However, the compounds are not limited to the structure shown below, but may also be those having charge transportability as well as a hydroxyl group.

$$X—(R_1—OH)_m \quad m \geqq 1$$

wherein

X: charge transportability providing group $R_1$: single bonding group, each of a substituted or an unsubstituted alkylene or arylene group m: preferably 1 to 5

Of these, listed as representative compounds are such as those described below. Further, for example, triethanolamine based compounds as described herein are those containing a triarylamine structure such as triphenylamine and the like, as well as having a hydroxyl group which bonds to a carbon atom via the carbon atom constituting said group.

1. Triarylamine Based Compounds

T-1

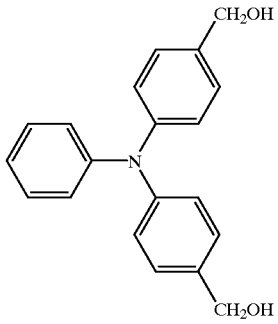

-continued
T-2
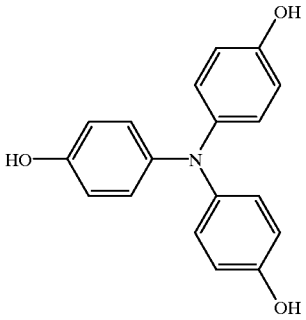
T-3
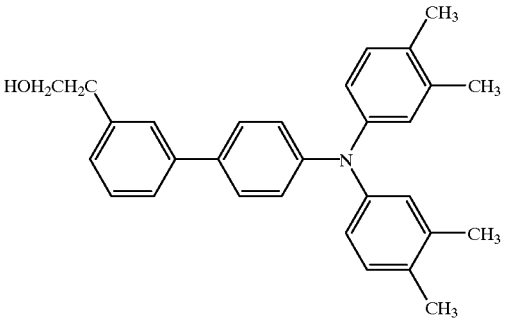
T-4
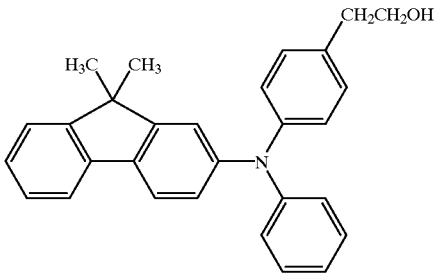
2. Hydrazine Based Compounds
H-1
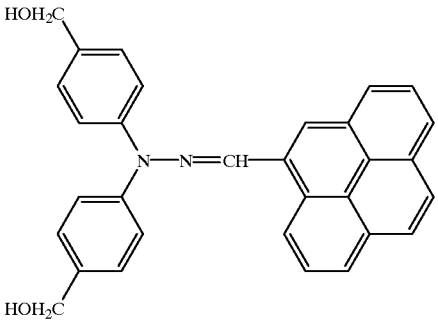
-continued
H-2
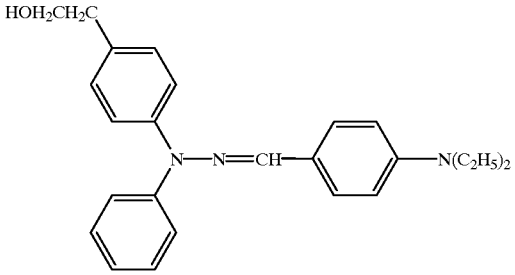
H-3
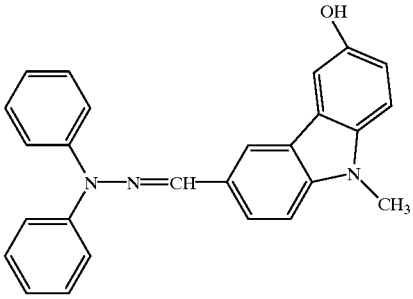
3. Stilbene Based Compounds
S-1
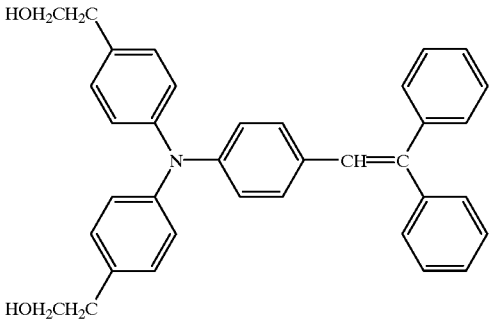
S-2
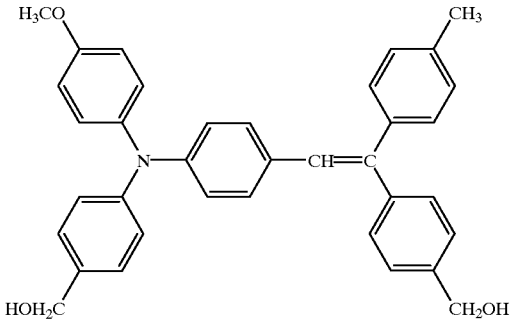

-continued

S-3

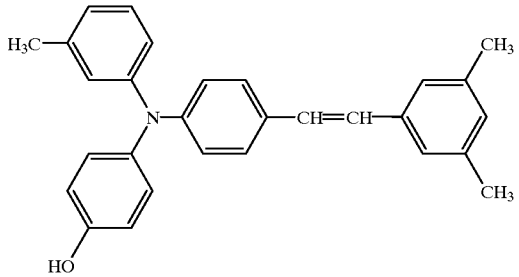

4. Benzidine Based Compounds

Be-1

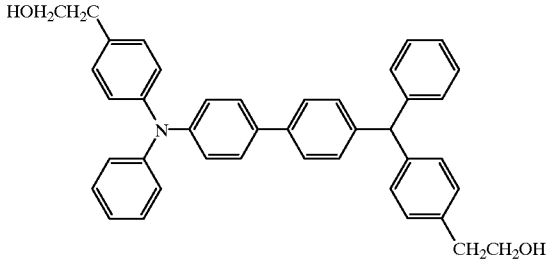

Be-2

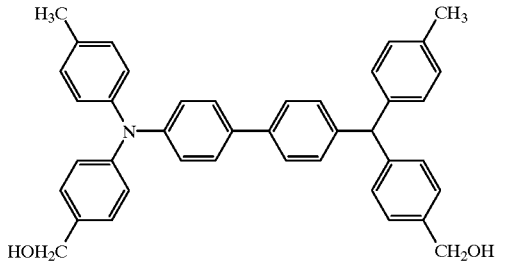

5. Butadiene Based Compounds

Bu-1

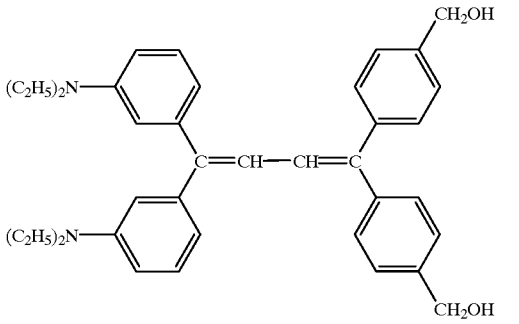

6. Other Compounds

So-1

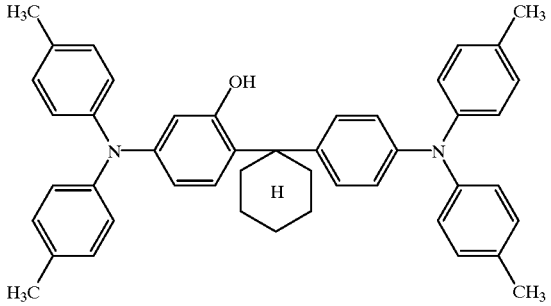

So-2

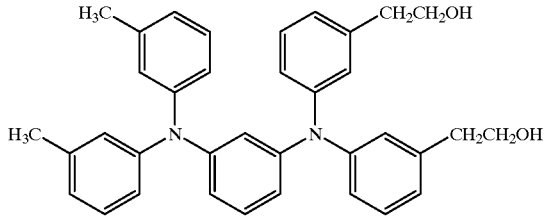

Next, a synthesis example of the charge transportable compound will be described.

Synthesis of Exemplified Compound T-1

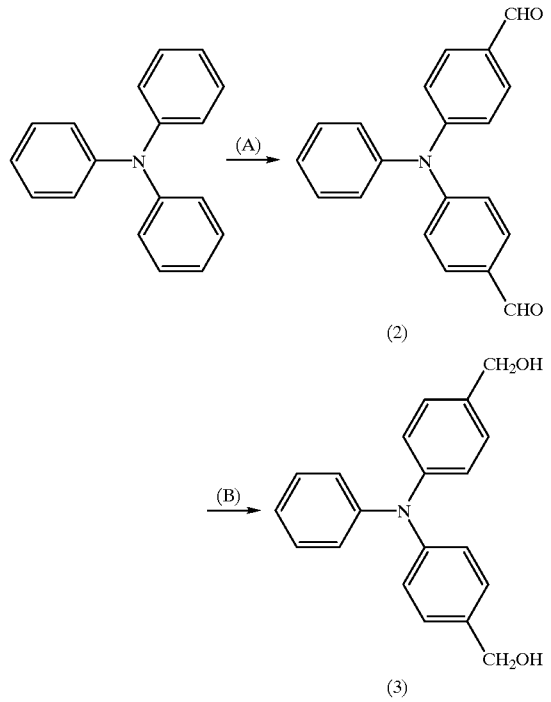

Step A

Placed in a four-neck flask equipped with a thermometer, a cooling tube, a stirrer, and a dropping funnel were 49 g of Compound (1) and 184 g of phosphorus oxychloride, which were heated and thereby dissolved. Employing the dropping funnel, 117 g of dimethylformamide was gradually added dropwise. Thereafter, the resulting mixture was stirred for about 15 hours while the temperature of the reacting solution was maintained between 85 and 95° C. Subsequently, the reaction solution was gradually poured into warm water, having a much larger volume than the same, and the resulting mixture was slowly cooled while stirring.

Deposited crystals were collected through filtration, then dried, and thus Compound (2) was obtained by purifying the resulting deposits through the adsorption of impurities employing silica gel and the like, and recrystallization employing acetonitrile. The yield was 30 g.

Step B

Placed in a flask were 30 g of Compound (2) and 100 ml of ethanol, and the resulting mixture was stirred. After gradually adding 1.9 g of sodium boron hydride, the resulting mixture was stirred for 2 hours while maintaining the temperature between 40 and 60° C. Subsequently, the reaction solution was poured into about 300 ml of water, and crystals were deposited while stirring. The deposited crystals were collected with filtration, well washed, and dried to obtain Compound (3). The yield was 30 g.

Synthesis of Exemplified Compound S-1

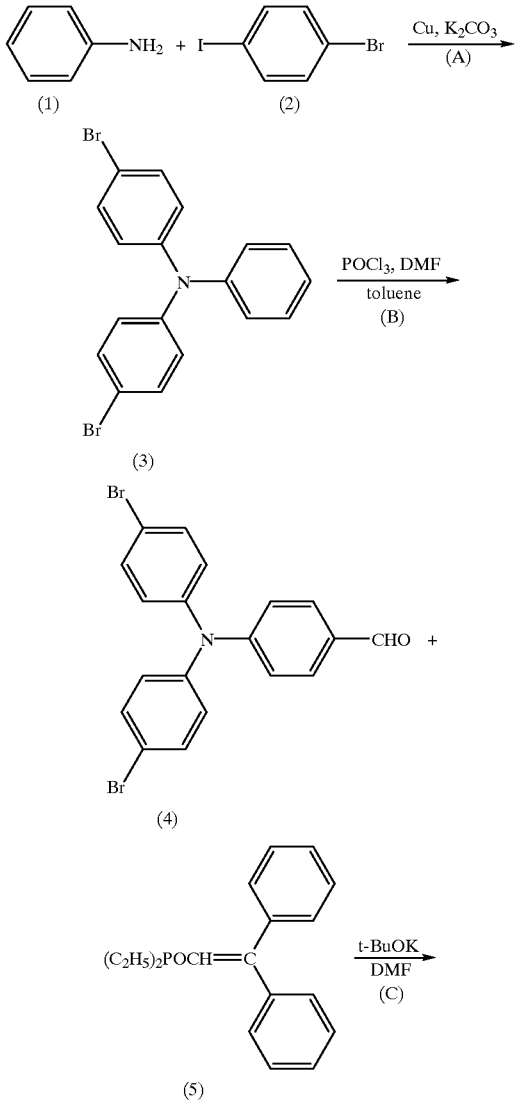

-continued

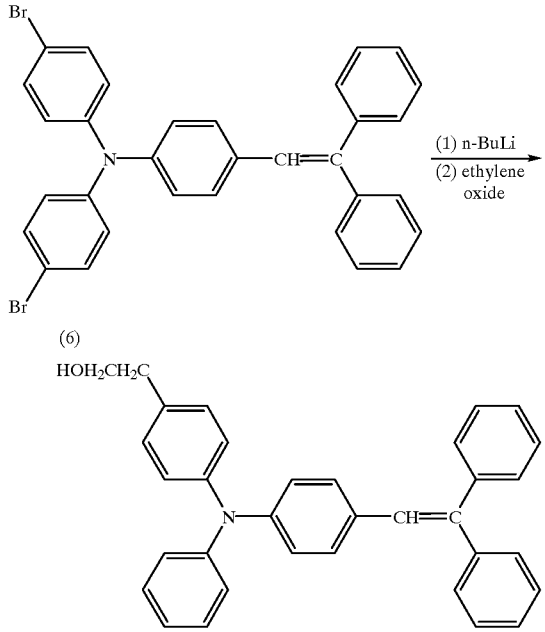

Step A

Placed in a 300 ml flask equipped with a thermometer and a stirrer were 30 g of Cu, 60 g of $K_2CO_3$, 8 g of Compound (1), and 100 g of Compound (2) and the resulting mixture was heated to about 180° C., and then stirred for 20 hours. After cooling, reaction products were collected through filtration and subjected to column purification to obtain 7 g of Compound (3).

Step B

A 100 ml flask equipped with a thermometer, a dropping funnel, an argon gas introducing unit, and a stirrer was filled with argon gas. Placed in said flask were 7 g of said Compound (3), 50 ml of toluene, and 3 g of phosphoryl chloride. Added slowly to the resulting mixture was dropwise 2 g of DMF and the resulting mixture was then heated to about 80° C. and stirred for 16 hours. The resultant was poured into about 70° C. water and then cooled. The resulting mixture was subjected to extraction employing toluene. The extract was washed until the pH of the wash water became 7. The resulting extract was dried employing sodium sulfate, then concentrated, and was then subjected to column purification to obtain 5 g of Compound (4).

Step C

Placed in a 100 ml flask equipped with an argon gas introducing unit and a stirrer were 1.0 g of t-BuOK and 60 ml of DMF, and said flask was filled with argon gas. Added to the resulting mixture were 2.0 g of said Compound (4) and 2.2 g of Compound 5, and the resulting mixture was stirred at room temperature for one hour. The resultant was poured into water having a much larger volume than the same, and was then subjected to extraction employing toluene. The resulting extract was water washed, and then dried employing sodium sulfate. Thereafter, the dried extract was concentrated, and subjected to column purification to obtain 2.44 g of Compound (6).

Step D

Placed in a 100 ml flask equipped with a thermometer, a dropping funnel, an argon gas introducing unit, and a stirrer was toluene, and the flask was then filled with argon gas. To this, 15 ml of a hexane solution (1.72 M) of n-BuLi was added and the resulting mixture was heated to 50° C. Added dropwise to said resulting mixture was a solution prepared by dissolving 2.44 g of Compound (6) in 30 ml of toluene, and the resulting mixture was stirred for 3 hours while maintaining the temperature at 50° C. After cooling the resulting mixture to −40° C., 8 ml of ethylene oxide were added, heated to −15° C. and stirred for one hour. Thereafter, the resulting mixture was heated to room temperature, and mixed with 5 ml of water, subjected to extraction employing 200 ml of ether. The resulting extract was washed with saturated salt water. After washing until the pH of the washing water became, the extract was dried employing sodium sulfate, concentrated and subjected to column purification to obtain 1.0 g of Compound (7).

Next, specific examples of charge transportable compounds having a mercapto group will be illustrated below.

The charge transportable compounds having a mercapto group as described herein are charge transport compounds having commonly employed structures, as well as compounds having a mercapto group. Namely, representatively listed can be the charge transportable compounds represented by the general formula described below, which bond to organic silicone compounds and are capable of forming a resin layer. However, the compounds are not limited to the structure described below but may also be those having charge transportability as well as a mercapto group.

$$X—(R_1—SH)_m m \geqq 1$$

wherein

X: charge transportability providing group $R_1$: single bonding group, each of a substituted or an unsubstituted alkylene group or an arylene group m: preferably 1 to 5

Of these, listed as representative compounds are such as those described below.

V-1

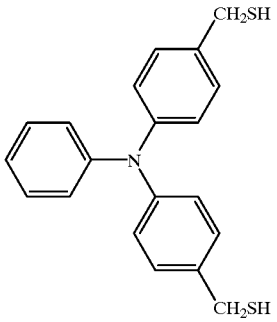

V-2

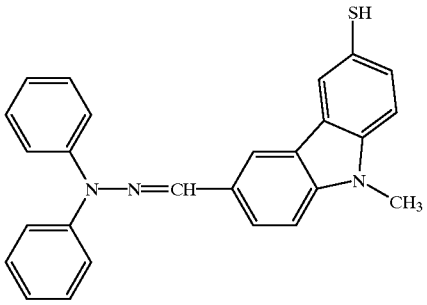

-continued

V-3

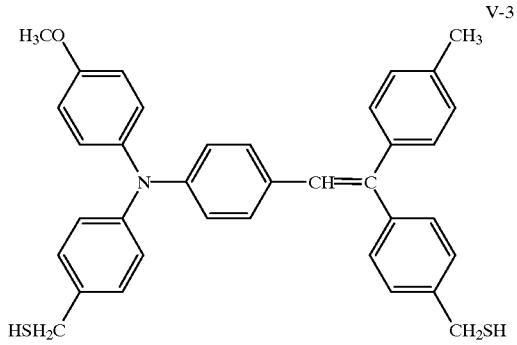

V-4

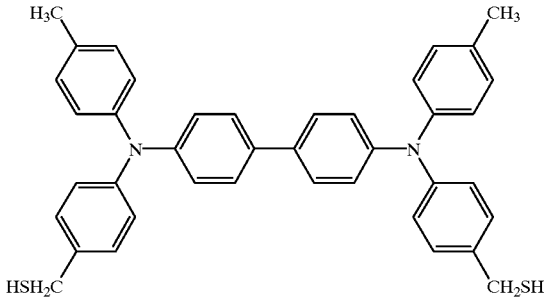

V-5

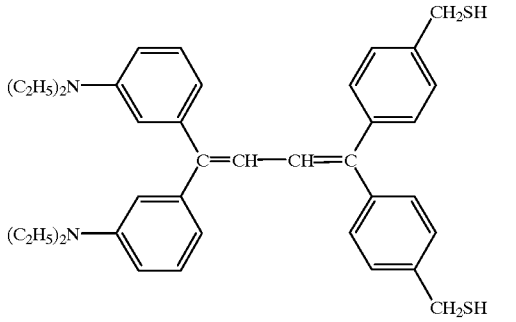

Further, specific examples of charge transportable compounds having an amino group are illustrated below.

The charge transportable compounds having an amino group as described herein are charge transport compounds having commonly employed structures, as well as compounds having an amino group. Namely, representatively listed can be the charge transportable compounds represented by the general formula described below, which bond to organic silicone compounds and are capable of forming a resin layer. However, the compounds are not limited to the structure described below but may be those having charge transportability as well as an amino group.

$$X—(R_1—NR_2H)_m m \geqq 1$$

wherein

X: charge transportability providing group $R_1$: single bonding group, each of a substituted or an unsubstituted alkylene group or an arylene group $R_2$: H, a substituted or unsubstituted alkyl group, a substituted or an unsubstituted aryl group m: preferably 1 to 5

Of these, listed as representative compounds are such as those described below.

W-1

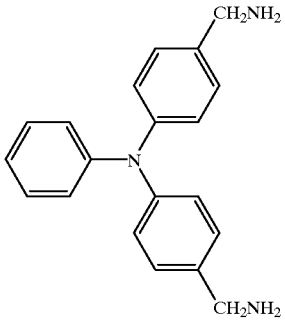

W-2

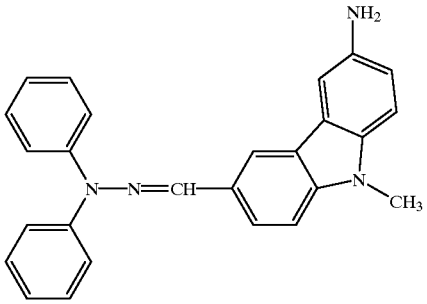

W-3

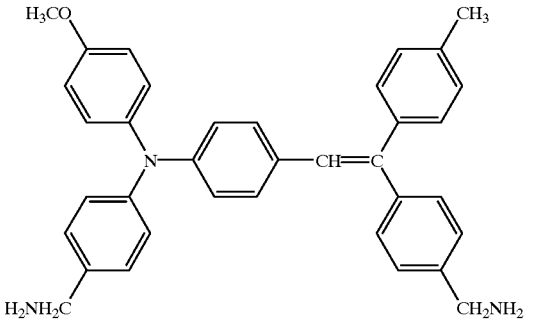

W-4

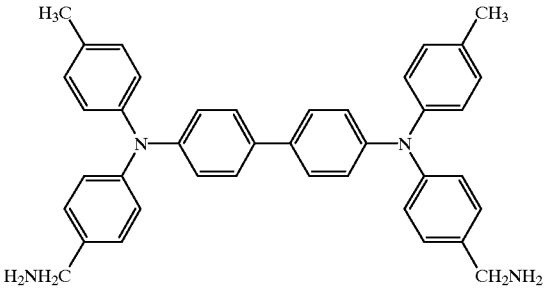

W-5

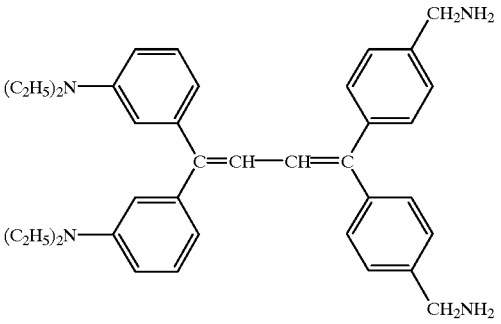

-continued

W-6

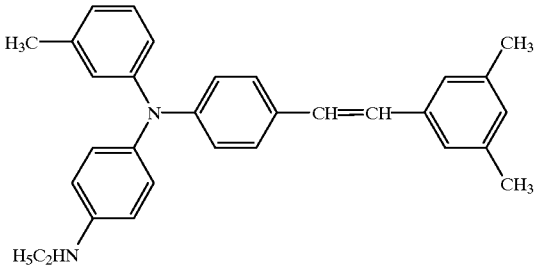

Of charge transportable compounds having an amino group, in the case of primary amine compounds (—$NH_2$), two hydrogen atoms may react with the organic silicone compound, and bonding to the siloxane structure may take place.

In the case of secondary amine compounds (—NHR), one hydrogen atom may react with the organic silicone compound, and the remaining R may be any of a remaining group as a branch, a group resulting in a crosslinking reaction, or a compound group having charge transportability.

As for the layer structure of the electrophotographic photoreceptor, the preferred structure is such that the resin layer of the-present invention is applied onto a photosensitive layer composed of a charge generating layer, a charge transport layer, or a charge generating-charge transport layer (a single layer-type photosensitive layer having the function of both charge generation and charge transport). Furthermore, the above-mentioned charge generating layer, charge transport layer, or charge generating-charge transport layer may be composed of a plurality of layers.

The charge generating materials (CGM) incorporated into the photosensitive layer of the present invention include, for example, phthalocyanine pigments, polycyclic quinone pigments, azo pigments, perylene pigments, indigo pigments, quinacridone pigments, azulenium pigments, squarylium pigments, cyanine dyes, pyrylium dyes, thiopyrylium dyes, xanthene dyes, triphenylmethane dyes, styryl dyes, and the like. These charge generating materials (CGM) may be employed individually or in combination with a suitable binder resin to form a resin layer.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives derivative, quinazoline derivatives, benzofuran derivatives, acridine derivatives, phenazine derivatives, aminostilbene derivatives, poly-N-vinylcarbazole, poly-1-vinylpyrene, poly-9-vinylanthracene, and the like. These charge transport materials are generally employed together with a binder to form a layer.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole, and the like.

In the present invention, the ratio of the charge generating material in the charge generating layer to the binder resin is preferably between 1:5 and 5:1 in terms of weight ratio. Further, the thickness of the charge generating layer is preferably no more than 5 μm, and is more preferably between 0.05 and 2 μm.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 3:1 and 1:3 in terms of weight ratio.

The thickness of the charge transport layer is preferably between 5 and 50 μm, and is more preferably between 10 and 40 μm. Furthermore, when a plurality of charge transport layers are provided, the thickness of the upper charge transport layer is preferably no more than 10 μm, and is preferably less than the total layer thickness of the charge transport layer provided under the upper layer of the charge transport layer.

The resin layer comprising the above-mentioned hardenable siloxane based resin may be employed as the above-mentioned charge transport layer. However, said layer is preferably provided as another layer on a photosensitive layer such as a charge transport layer and a charge generating layer, or a single-type charge generating-transport layer. In such a case, an adhesive layer is preferably provided between the above-mentioned photosensitive layer and the resin layer of the present invention.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like. Of these, most preferably employed are dichloromethane, 1,2-dichloroethane or methyl ethyl ketone. Furthermore, these solvents may be employed individually or in combination of two types or more.

Next, electrically conductive supports for use in the electrophotographic photoreceptor of the present invention include:

1) metal plates such as aluminum, stainless steel, and the like
2) those prepared by laminating or evaporating a thin metal layer such as aluminum, palladium, gold, and the like onto a support such as paper, plastic film, and the like
3) those prepared by coating or evaporating a layer composed of electrically conductive compounds such as an electrically conductive polymer, indium oxide, tin oxide, and the like.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, detailed in Japanese Patent Publication Open to Public Inspection Nos. 3-90250 and 3-269238, while the above-mentioned circular amount control type coating is detailed in, for example, Japanese Patent Publication Open to Public Inspection No. 58-189061.

After forming the above-mentioned surface layer by coating, the photoreceptor of the present invention is heat dried at at least 50° C. and preferably at a temperature of 60 to 200° C. This heat drying not only decreases the amount of the residual coating solvent, but can also sufficiently harden the siloxane based resin layer.

In the present invention, an interlayer, functioning as a barrier, may be provided between the electrically conductive support and the photosensitive layer.

Listed as an interlayer are materials for the interlayer such as casein, polyvinyl alcohols, nitrocellulose, ethylene-acrylic acid copolymers, polyvinyl butyral, phenol resins, polyamides (nylon 6, nylon 66, nylon 610, copolymerized nylon, alkoxymethylated nylon, and the like), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 μm, and is most preferably between 0.1 and 5 μm.

In the present invention, further, a coating for covering surface defects of a support may be applied between the support and the interlayer, and particularly, provided may be an electrically conductive layer for the purpose of minimizing the formation of interference fringes which result in problems when a laser beam is employed for image input. Such an electrically conductive layer may be formed by coating a composition prepared by dispersing an electrically conductive powder, such as metal particles, metal oxide particles, and the like, into a suitable binder resin, and subsequently drying the coating. The thickness of the electrically conductive layer is preferably between 5 and 40 μm, and is most preferably between 10 and 30 μm.

In addition, the shape of the support may be a drum, sheet or belt, and is preferably optimum for the electrophotographic apparatus to which the support is applied.

The electrophotographic photoreceptor of the present invention may generally be applied to electrophotographic apparatuses such as copiers, laser printers, LED printers, liquid crystal shutter printers, and the like. In addition, it may widely be applied to apparatuses for display, recording, offset printing, plate making, facsimile, to which electrophotographic techniques are applied.

FIG. 1 shows a cross-sectional view of an image forming apparatus comprising the electrophotographic photoreceptor of the present invention.

In FIG. 1, reference numeral 10 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 1 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means (not shown in the figure) so as to form a layer having a thickness of 100 to 600 $\mu$m on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the photoreceptor, the above-mentioned blade 221 is immediately withdrawn after cleaning the photoreceptor surface of the photoreceptor drum.

Further, reference numeral 30 is a detachable cartridge in which a photoreceptor, a transfer unit, a separation unit, and a cleaning unit are integrated.

The present electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

EXAMPLES

The present invention will now be detailed with reference to examples below.

Example-1

A photoreceptor was prepared as described below.

<Interlayer>

| | |
|---|---|
| Polyamide resin (CM8000, manufactured by Toray Co.) | 60 g |
| Methanol | 2000 ml |

were mixed and dissolved to prepare an interlayer coating solution. The resulting coating solution was applied onto a cylindrical aluminum base body, employing an immersion coating method, and dried at room temperature to form a 0.3 $\mu$m thick interlayer.

<Charge Generating Layer>

| | |
|---|---|
| Charge generating material (C1) | 60 g |
| Silicone resin solution (15% KR5240 xylene-butanol solution, manufactured by Shin-Etsu Kagaku Kogyo Co.) | 700 g |
| Methyl ethyl ketone | 2000 ml |

were mixed and dispersed for 10 hours employing a sand mill to prepare a charge generating layer coating composition. The resulting coating composition was applied onto the above-mentioned interlayer, employing an immersion coating method, to form a 0.2 μm thick charge generating layer.

<Charge Transport Layer>

| | |
|---|---|
| Charge transport material (D1) | 200 g |
| Bisphenol Z type polycarbonate (Upiron Z300, manufactured by Mitsubishi Gas Kagaku Co.) | 300 g |
| 1,2-dichloroethane | 2000 ml |

were mixed and dissolved to prepare a charge transport coating composition. The resulting coating composition was applied onto the above-mentioned charge generating layer employing an immersion coating method, to form a 20 μm thick charge transport layer.

C1

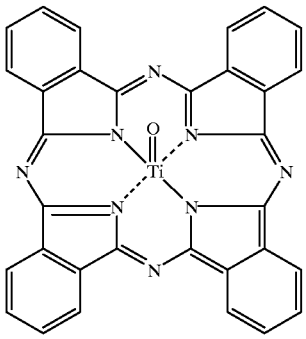

D1

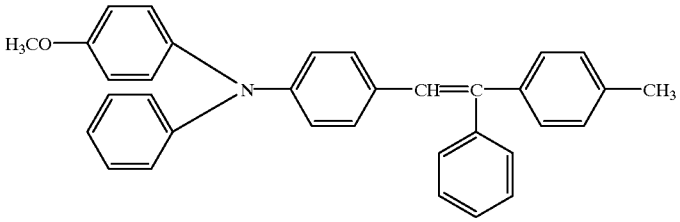

Onto the resulting coating, additionally applied was a coating composition prepared by diluting commercially available Primer PC-7J (manufactured by Shin-Etsu Kagaku Kogyo Co.) with the equal volume of toluene, and was dried at 100° C. for 30 minutes to form a 0.3 μm thick adhesive layer.

Molecular Sieve 4A was added to 10 weight parts of a polysiloxane resin (containing one weight percent of a silanol group) comprised of 80 mole percent of the methylsiloxane unit and 20 mole percent of the methylphenylsiloxane unit, the resulting mixture was left undisturbed for 15 hours, and then dehydrated. The resulting resin was dissolved in 10 weight parts of toluene, and 5 weight parts of methyltrimethoxysilane, and 0.2 weight part of dibutyl tin acetate were added to the resulting solution to form a uniform solution.

Added to the resulting solution were 6 weight parts of dihydroxymethyltriphenylamine (Exemplified Compound T-1) and then mixed. The resulting solution was applied to the resulting coating as a 1 μm thick protective layer and subsequently dried at 120° C. for one hour to prepare the photoreceptor of Example-1.

Evaluation was carried out in such a manner that the present photoreceptor was installed in a Konica 7050 (digital copier manufactured by Konica Corp.) and an initial charge potential was set at −650 volts.

At the two ambient conditions of 20° C. and RH 60%, and 30° C. and RH 80%, 50,000 test prints were made employing A4 size sheets and images were evaluated at the initial print and the 50,000th print. Results showed that the initial print and the 50,000th prints resulted in no background staining under both ambient conditions cited above, and resulted in a reflection density of at least 1.2 of the solid black portion as well as images of excellent uniformity. Furthermore, the abraded surface amount of the photoreceptor after finishing the 50,000th print was found to be markedly minimal as less than 0.1 μm. In addition, almost no abrasion was observed on the surface of the photoreceptor, and no image defects due to abrasion marks were observed on halftone images.

Comparative Example-1

On the other hand, Comparative Example-1 was prepared in the same manner, except that dihydroxymethyltriphenylamine in the above-mentioned protective layer was replaced with 4-[2-(triethoxysilyl)ethyl]triphenylamine.

Evaluation was carried out in the same manner as the above-mentioned Example-1. At an ambient condition of 20° C. and RH 60%, good images were obtained, while at an ambient condition of 30° C. and RH 80%, background staining was visible on the 50,000th print as well as image blurring at one portion of said image.

Example-2

The photoreceptor of Example-2 was prepared in the same manner, except that the polysiloxane resin in Example-1 was replaced with a polysiloxane resin (containing 2 weight parts of a silanol group) comprised of 80 mole percent of the methylsiloxane unit and 20 mole percent of the dimethylsiloxane unit.

Example-3

The photoreceptor of Example-3 was prepared in the same manner, except that the polysiloxane resin in Example-1 was replaced with a polysiloxane resin (containing 2 weight percent of a silanol group) comprised of 30 mole percent of methylsiloxane unit, 40 mole percent of the ethylsiloxane unit, 20 mole percent of the dimethylsiloxane unit, and 10 mole percent of diethylsiloxane.

Example-4

The photoreceptor of Example-4 was prepared in the same manner, except that the polysiloxane resin in Example-1 was replaced with a polysiloxane resin (containing 2 weight percent of a silanol group) comprised of 30 mole percent of the methylsiloxane unit, 30 mole percent of the phenylsiloxane unit, 20 mole percent of the dimethylsiloxane unit, and 20 mole percent of diethylsiloxane.

Example-5

The photoreceptor of Example-5 was prepared in the same manner, except that the dihydroxymethyltriphenylamine (Exemplified Compound T-1) in Example-1 was replaced with hydrazone type Exemplified Compound H-1.

Example-6

The photoreceptor of Example-6 was prepared in the same manner, except that the dihydroxymethyltriphenylamine (Exemplified Compound T-1) in Example-1 was replaced with stilbene type Exemplified Compound S-1.

Example-7

The photoreceptor of Example-7 was prepared in the same manner, except that the dihydroxymethyltriphenylamine (Exemplified Compound T-1) in Example-1 was replaced with benzidine type Exemplified Compound Be-1.

Example-8

The photoreceptor of Example-8 was prepared in the same manner, except that the dihydroxymethyltriphenylamine (Exemplified Compound T-1) in Example-1 was replaced with butadiene type Exemplified Compound Bu-1.

Example-9

The photoreceptor of Example-9 was prepared in the same manner, except that the dihydroxymethyltriphenylamine (Exemplified Compound T-1) in Example-1 was replaced with Exemplified Compound So-1.

Example 10

Up to the adhesive layer, Example 10 was prepared in the same manner as Example-1.

Added to 60 weight parts of isopropanol were a commercially available hardenable siloxane resin KP-854 (manufactured by Shin-Etsu Kagaku Kogyo Co.) and was dissolved uniformly. Mixed with the resulting solution were 6 weight parts of dihydroxymethyltriphenylamine (Exemplified Compound T-1), in the same manner as Example-1. The resulting solution was applied onto the resulting coating so as to form a protective layer having a dry layer thickness of 1 $\mu$m, and dried at 120° C. for one hour, to prepare the photoreceptor of Example-10.

Example-11

The photoreceptor of Example-11 was prepared in the same manner, except that the siloxane resin KP-854 in Example-10 was replaced with X-40-2239 (manufactured by Shin-Etsu Kagaku Kogyo Co.).

Example-12

The photoreceptor of Example-12 was prepared in the same manner, except that the siloxane resin KP-854 in Example-10 was replaced with X-40-2269 (manufactured by Shin-Etsu Kagaku Kogyo Co.).

Example-13

The photoreceptor of Example-13 was prepared in the same manner, except that dihydroxymethyltriphenylamine (Exemplified Compound T-1) in Example-1 was replaced with Exemplified Compound V-1.

Example-14

The photoreceptor of Example-14 was prepared in the same manner, except that dihydroxymethyltriphenylamine (Exemplified Compound T-1) in Example-1 was replaced with Exemplified Compound V-3.

Example-15

The photoreceptor of Example-15 was prepared in the same manner, except that dihydroxymethyltriphenylamine (Exemplified Compound T-1) in Example-1 was replaced with Exemplified Compound W-1.

Example-16

The photoreceptor of Example-16 was prepared in the same manner, except that dihydroxymethyltriphenylamine (Exemplified Compound T-1) in Example-1 was replaced with Exemplified Compound W-3.

Photoreceptors of Examples-2 through -16 were evaluated in the same manner as the photoreceptor of Example-1.

At each of two ambient conditions of 20° C. and RH 60%, and 30° C. and RH 80%, the initial print as well as the 50,000th print resulted in no background staining, and resulted in reflection density of at least 1.2 of the solid black portion as well as images with excellent uniformity. Furthermore, the abrasion amount of the photoreceptor after 50,000 prints was found to be markedly minimal, at less than 0.1 $\mu$m. In addition, almost no abrasion was observed on the surface of the photoreceptor, and no image defects, due to abrasion marks, were observed on halftone images.

According to the present invention, it is possible to develop an electrophotographic photoreceptor which exhibits excellent abrasion resistance and stable electrophotographic properties during repeated use at high temperature and humidity, and consequently results in excellent images during repeated use, and a production method thereof, and then it is possible to provide a process cartridge and an image forming apparatus using said photoreceptor.

The investigation has been made in functional group of compound contained in the coating composition for forming the resin layer at the surface of the photoreceptor for the purpose to strengthen of the surface of the photoreceptor. As the result a preferable characteristics are obtained.

An electrophotographic photoreceptor comprises plural resin layers provided on a support. One of the resin layer comprises at least one of an organic silicone compound containing hydroxy or hydrolizable group and condensation product of the organic silicon compound containing hydroxy or hydrolizable group and a compound represented by formula (1).

Formula (1)

$$A—(Z)_k$$

In the formula, A is two- or more valent group comprising aromatic or heterocyclic ring therein, Z is hydroxy, amino, or mercapto group, k is an integer of 2 to 10.

The layer is preferably formed by coating and drying a coating composition comprising at least one of an organic silicon compound containing hydroxy or hydrolizable group and condensation product of the organic silicon compound containing hydroxy or hydrolizable group and a compound represented by formula (1).

Preferable example of compound represented by formula (1) is represented by the formula (2).

Formula (2)

$$A—(R_1Z)_k$$

In the formula, A is two- or more valent group comprising aromatic or heterocyclic ring therein, $R_1$ is nonsubstituted or substituted alkylene group having 1–20 carbon atoms, Z is hydroxy, amino, or mercapto group, k is an integer of 2 to 10.

Preferable example of compound represented by formula (2) is represented by the formula (3).

Formula (2)

$$A—(CR_2R_3OH)_k$$

In the formula, A is two- or more valent group comprising aromatic or heterocyclic ring therein, each of $R_2$ and $R_2$ is a hydrogen atom, nonsubstituted or substituted alkylene group having 1–6 carbon atoms, or an aryl group, k is an integer of 2 to 10.

In another embodiment of he invention, one of the resin layer comprises at least one of an organic silicon compound containing hydroxy or hydrolizable group and condensation product of the organic silicon compound containing hydroxy or hydrolizable group and a compound represented by formula (1).

Formula (4)

$$B—(Z)_k$$

In the formula, B is two- or more valent group comprising a charge transporting component therein, Z is hydroxy, amino, or mercapto group, k is an integer of 2 to 10.

The layer is preferably formed by coating and drying a coating composition comprising at least one of an organic silicon compound containing hydroxy or hydrolizable group and condensation product of the organic silicon compound containing hydroxy or hydrolizable group and a compound represented by formula (4).

Preferable example of compound represented by formula (4) is represented by the formula (5).

Formula (5)

$$B—(R_1Z)_k$$

In the formula, B is two- or more valent group comprising a charge transporting component therein, $R_1$ is nonsubstituted or substituted alkylene group having 1–20 carbon atoms, Z is hydroxy, amino, or mercapto group, k is an integer of 2 to 10.

In the compound represented by formula (5) preferable example is that B is $Ar_1Ar_2NAr_3$, $R_1$ is $CR_2R_3$, and Z is hydroxy group, wherein $Ar_1$, $Ar_2$ and $Ar_3$ is an alkyl or aryl group.

Examples of the organic silicone compound include those represented by the general formula (7). The condensation products of organic silicone compound having a hydroxyl group or a hydrolyzable group include oligomers which is formed when it is dissolved in a solvent A resin layer comprising a siloxane based resin forming a three dimensional net structure is formed by applying such coating liquid compositions onto the electrically conductive support and hardening the resulting coating.

General Formula (7)

$$(R)_n—Si—(X)_{4-n}$$

wherein R represents an organic group in such a form in which a carbon atom directly bonds to the silicon atom, X represents a hydroxyl group or a hydrolyzable group, and n represents an integer from 0 to 3.

In the organic silicon compounds, organic groups in such a form in which carbon directly bonds to silicon represented by R, include alkyl groups such as methyl, ethyl, butyl, etc.; aryl groups such as phenyl, tolyl, naphthyl, biphenyl, etc.; epoxy-containing groups such as γ-glycydoxypropyl, β-(3,4-epoxycyclohexyl)ethyl, etc.; methacryloyl- or acryloyl-containing groups such as γ-acryloxypropyl, γ-methacryloxypropyl; a hydroxyl-containing groups such as γ-hydroxypropyl, 2,3-dihydroxypropyloxypropyl; vinyl-containing groups such as vinyl, propenyl, etc.; mercapto-containing groups such as γ-mercaptopropyl, etc.; amino-containing groups such as γ-aminopropyl, N-β(aminoethyl)-γ-aminopropyl, etc.; halogen-containing groups such as γ-chloropropyl, 1,1,1-trifluoroproyl, nonafluorohexyl, perfluoroctylethyl, etc.; and others such as nitro- or cyano-substituted alkyl groups. In particular, the alkyl groups such as methyl, ethyl, propyl, butyl, etc. are preferred. Furthermore, listed as the hydrolyzable group for X are an alkoxy group such as methoxy, ethoxy, etc., a halogen group or an acyloxy group. In particular, preferred is an alkoxy group having no more than 6 of carbon atoms.

Furthermore, the organic silicon compounds represented by the general formula (7) may be employed individually or in combination of two or more types. As for at least one of the employed organic silicone compound represented by the general formula, organic silicon compounds having n of 0 or 1 are preferably employed.

Further, when n is at least 2 in the specific organic silicon compounds represented by general formula (7), a plurality of Rs may be the same or different. Further, when n is no more than 2, similarly, a plurality of Xs may be the same or different. Furthermore, when two or more types of the organic silicon compounds represented by general formula (7) are employed, R and X may be the same or different in each compound.

With the another embodiment of the electrophotographic photoreceptor, colloidal silica is preferably incorporated into a coating composition comprising the above-mentioned organic silicon compounds or hydrolyzed condensation products thereof. The colloidal silica refers to silicon dioxide particles which are a colloid dispersed into a dispersion medium. The colloidal silica may be added during any steps of preparation of coating composition. The colloidal silica may be added in the form of an aqueous or alcoholic sol, or aerosol prepared in a gas phase may be directly dispersed into the coating.

Other than this, metal oxides such as titania, alumina, and the like may be added in the form of a sol or a fine particle dispersion.

The rigidity of the resin layer film is provided by the crosslinking structure formed by the colloidal silica and the above-mentioned organic silicon compound having a 4-function (n=0) or a 3-function (n=1). As the content ratio of a 2-functional organic silicon compound (n=2) increases, rubber elasticity as well as hydrophobicity increases. 1-functional organic silicon compounds (n=3) result in no polymer, but increases hydrophobicity while reacting with unreacted residual SiOH.

The electrophotographic photoreceptor has a resin layer which is composed of (a) a siloxane based resin having a crosslinking structure generated from a coating composition containing an organic silicon compound having hydroxyl group or hydrolyzable group or a condensation products of organic silicon compound having hydroxyl group or hydrolyzable group, and (b) a condensation product of an aromatic alkyl alcohol compound represented by the above-mentioned general formula (1).

In another embodiment an electrophotographic photoreceptor has a resin layer which is composed of (a) a siloxane based resin having a crosslinking structure generated from a coating composition containing an organic silicon compound having the hydroxyl group or hydrolyzable group and condensation products of the organic silicon compound, and (b) the condensation product of a charge transportable compound represented by the above-mentioned general formula (4).

Furthermore, the compound represented by the above-mentioned general formula (1), or the compounds represented by the above-mentioned general formula (4), may be incorporated into a siloxane based resin layer through condensation reaction with the hydroxyl group on the colloidal silica surface.

A siloxane based ceramic layer may be employed by adding metal hydroxides (for example, hydrolyzed products of each alkoxides of aluminum, titanium, and zirconium) other than colloidal silica.

In other embodiments, B in the general formula (4) represents a divalent or multivalent group comprising a charge transferable compound structure. The charge transferable compound structure, as described herein, means that the compound structure, excluding the Z group in the general formula (4), possesses charge transferability, or the compound represented by (BH) which is the above mentioned Z group is substituted by hydrogen atom.

Still further, the above-mentioned charge transferable compounds are those exhibiting the drift mobility of electrons or positive holes. As another definition, these compounds can also be defined as these in which an electric current, due to the charge transfer, can be detected employing methods known in the art which can detect the charge transferability, such as a Time-Of-Flight method and the like.

The composition ratio in a coating liquid composition of the above-mentioned organic silicon compounds having a hydroxyl group or a hydrolyzable group and condensation products thereof to the compound (I) in the above-mentioned general formulas (1) through (6) is preferably between 100:3 and 50:100 by weight, and is more preferably between 100:10 and 50:100.

Further, when metal oxides (J) such as colloidal silica and the like are added, 1 to 30 weight parts of (J) to 100 total weight parts of the components of the above-mentioned (H)+(I) are preferably employed.

When the above-mentioned (H) component is employed within the above-mentioned range, sufficient hardness without brittleness of the siloxane resin layer is obtained. The excess or shortage of the colloidal silica component of the (J) component produces a similar tendency to the (H) component. On the other hand, when the (I) component is less, the charge transferability of the siloxane resin layer sometimes becomes smaller, to result in a decrease in sensitivity, and a rise of residual potential, while the (I) component is excessive, results in the strength of the siloxane resin layer tending to weaker.

Furthermore, when a resin layer is formed employing the compounds represented by the above-mentioned general formulas (1) through (6), at least one of the compounds having a k of 2 represented by the general formulas (1) through (6) is preferably employed in combination with at least one of the compounds having a k of at least 3 represented by the same general formulas. The weight ratio of the compound having a k of 2 to that having a k of at least 3 may be arbitrarily chosen. However, 1 to 50 weight parts of the compound having a k of at least 3 to 100 weights parts of the compound having a k of 2 are especially preferred. By employing the compound having a k of 2 in combination with the compound having a k of at least 3, a resin layer can be obtained which exhibits improved strength, abrasion resistance due to the high crosslinking density, as well as enhanced cleaning properties.

Next, in order to promote the condensation reaction of the above-mentioned organic silicon compounds or compounds represented by formulas (1) through (6), condensation catalysts are preferably employed. The condensation catalysts include catalytic material, which works catalytically in the condensation reaction or promotes a reaction equilibrium of the condensation reaction to product phase.

Employed as such condensation catalysts may be hardening catalysts known in the art such as acids, metal oxides, metal salts, alkylaminosilane compounds, and the like, which have been employed in conventional silicon hard coating materials. Examples include alkali metal salts of any of the followings: organic carboxylic acids, nitrous acid, sulfurous acid, alminic acid, carbonic acid, and thiocyanic acid; organic amine salts (tetramethylammonium hydroxide, tetramethylammonium acetate); tin organic acid salts (stannous octoate, dibutyltin acetate, dibutyltin dilaurate, dibutyltin mercaptide, dibutyltin thiocarboxylate, dibutyltin maliate, and the like), and the like.

In the above-mentioned general formula (1) A represents a divalent or multivalent organic group comprising an aromatic ring or a heterocyclic ring in its chemical structure. Examples of the aromatic ring or the heterocyclic ring include aromatic rings such as benzene, naphthalene, indene, anthracene, phenanthrene, fluorene, pyrene, and the like, and heterocyclic rings such as furan, thiophene, pyran, thiopyran, benzofuran, benzothiphene, dibenzofuran, and the like. Further, these group may have substituents such as a halogen atom, an alkyl group, an alkoxide group, and the like, or may also have functional groups such as an ether group, a ketone group, an ester group, an amide group, and the like. Further, as the alkylene group of $R_1$, a methylene group is particularly preferred. Further, of the compounds represented by the above-mentioned general formula (1), the compounds represented by the general formula (2) are more preferred.

Representative exemplified commands represented by the general formulas (1), (2) and (3) are illustrated below.
(A-1)
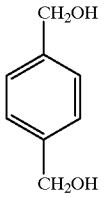
(A-2)
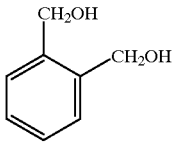
(A-3)
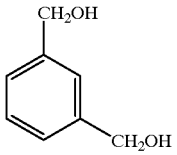
(A-4)
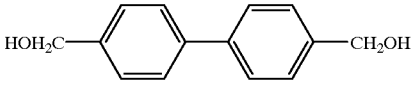
(A-5)
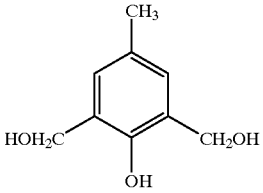
(A-6)
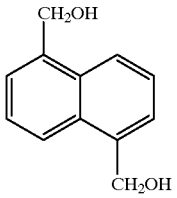
(A-7)
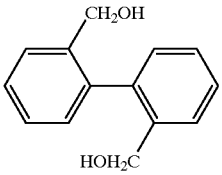
-continued
(A-8)
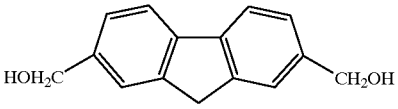
(A-9)
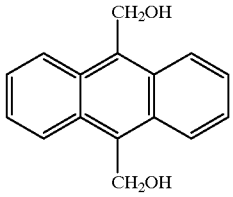
(A-10)
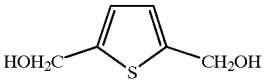
(A-11)
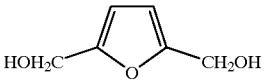
(A-12)
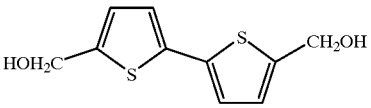
(A-13)
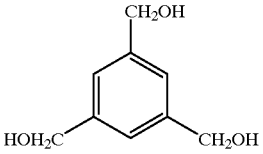
(A-14)
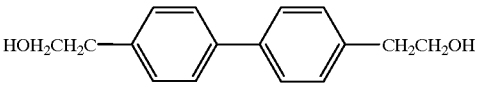
(A-15)
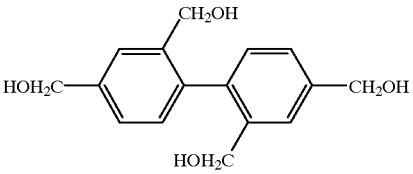
(A-16)
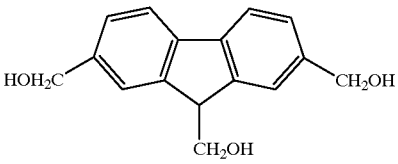

-continued (A-17)

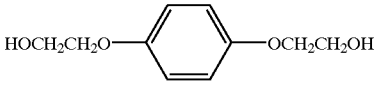

(A-18)

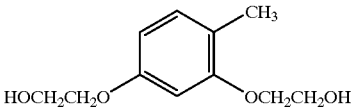

(A-19)

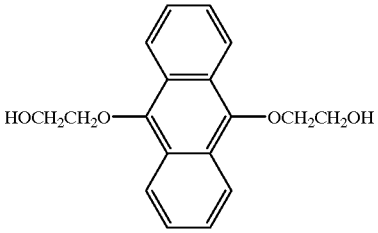

(A-20)

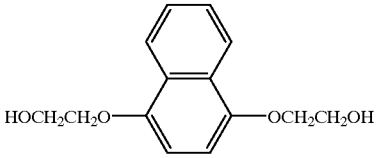

(A-21)

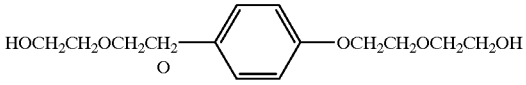

(A-22)

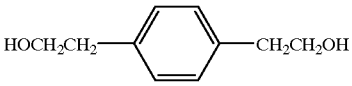

(A-23)

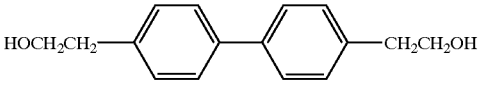

(A-24)

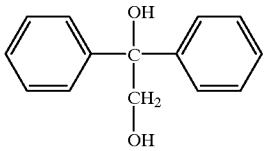

(A-25)

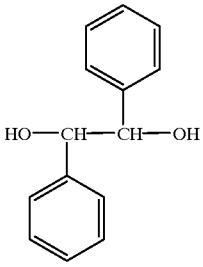

Compounds Z being amino group in Formula (1) are listed. As the amino group, preferable is primary (—NH2) or secondary (—NHR) because of their reactivity with the organic silicon compounds.

(A-26)

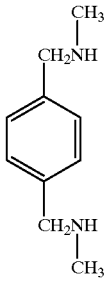

(A-27)

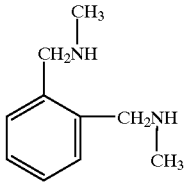

(A-28)

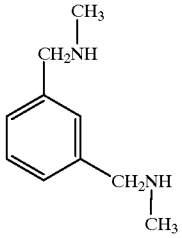

Compounds Z being mercapto group (—SH) in Formula (1) are listed.

(A-29)

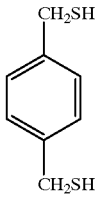

(A-30)

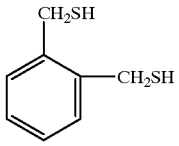

(A-31)

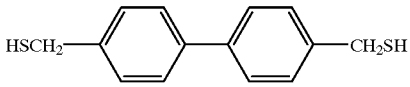

Compounds represented by formulas (4) through (6) are described. Listed as groups represented by B in the above-mentioned general formula (4) are groups having compound structure described below. Group having charge transportable compound structure represented by Formula B includes positive hole transport-type groups and electron transport-type groups.

Examples of positive hole transport-type groups are groups comprising two or more valent structural units such as oxazole, oxadiazole, thiazole, triazole, imidazole, imidazolone, imidazoline, bisimidazoline, styryl, hydrazone, benzidine, pyrazoline, triarylamine, oxazolone, benzothiazole, benzimidazole, quinazoline, benzofuran, acridine, phenazine, and the like, and groups derived from derivatives thereof. On the other hand, listed as electron transport type groups are groups comprising structural units such as succinic anhydride, maleic anhydride, phthalic anhydride, pyromellitic anhydride, mellitic anhydride, tetotacyanoethylene, tetotacyanoquinodimethane, nitrobenzene, trinitrobenzene, tetranitrobenzene, nitrobenzonitrile, picryl chloride, quinone chloride, chloranil, bromanil, benzoqunone, naphthoquinone, diphenoquinone, toropoquinone, anthraquinone, 1-chloroanthraquine, dinitroanthraquione, 4-nitrovbenzophenone, 4,4'-dinitrobenzophenone, 4-nitrobenzalmalondinitrile, α-cyano-β-(p-cyanophenyl)-2-(p-chlorophenyl)ethylene, 2,7-dinitrofluorenone, 2,4,7-trinitrofluorenone, 2,4,5,7-tetranitrofluorenone, 9-fluoronylydenedicyanomethylenemalonitrile, polynitro-9-fluoronylidenedicyanomethylenemalonitrile, picric acid, o-nitrobenzoic acid, p-nitrobenzoic acid, 3,5-dinitrobenzoic acid, perfluorobenzoic acid, 5-nitrosalicylic acid, 3,5-dinitrosalicylic acid, phthalic acid, mellitic acid, and the like.

Representative compound examples represented by general formulas (4) through (6) will be listed below. Of these, compounds which are preferred for improvements in electrophotographic photoreceptor properties are those having chemical structures represented by the general formula (5), and more preferred are those having chemical structures represented by the general formula (6).

Examples of compound Z being OH in the Formula (4) are listed.

(B-1)

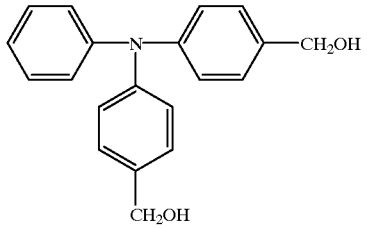

(B-2)

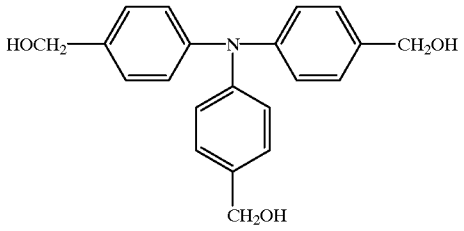

(B-3)

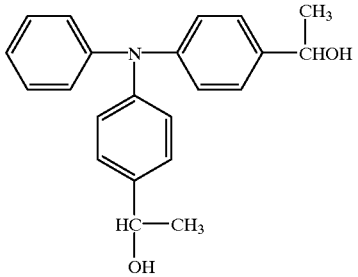

(B-4)

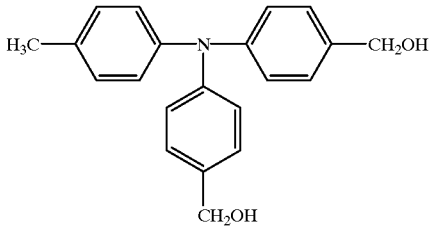

-continued
(B-5)
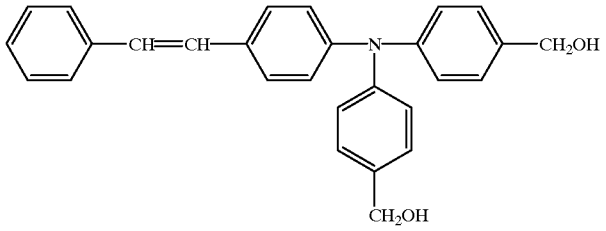
(B-6)
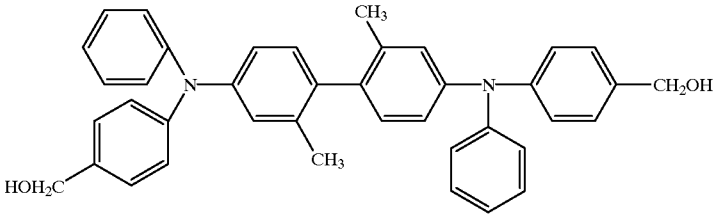
(B-7)
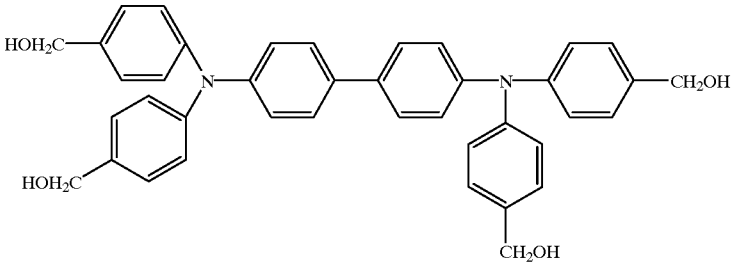
(B-8)
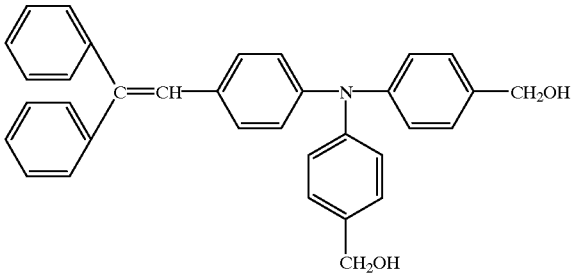
(B-9)
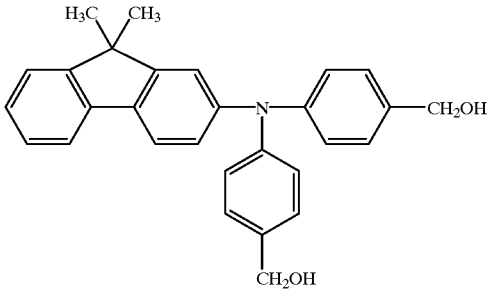
(B-10)
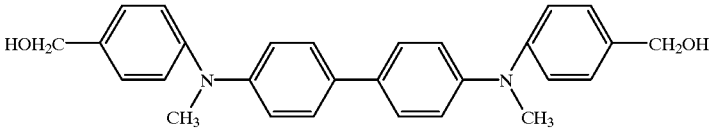

-continued
(B-11)
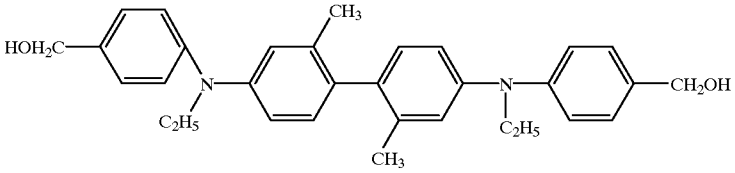
(B-12)
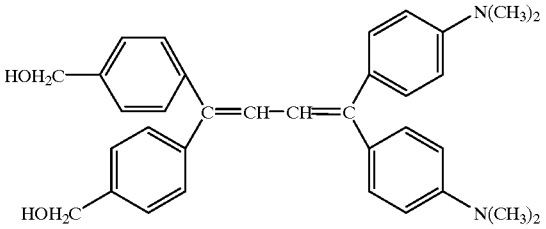
(B-13)
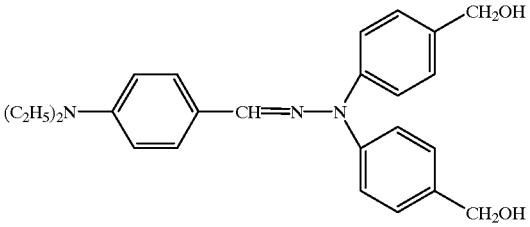
(B-14)
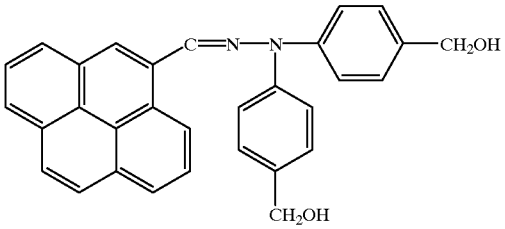
(B-15)
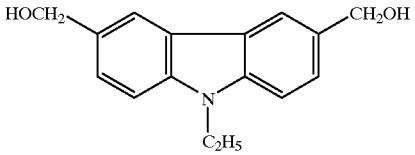
(B-16)
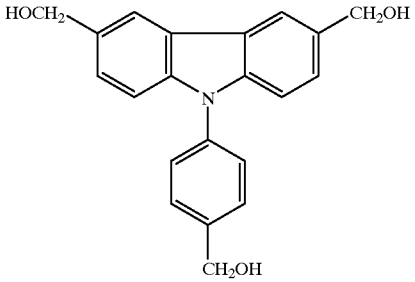

-continued
(B-17)
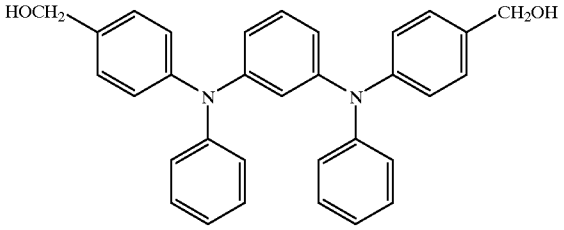
(B-18)
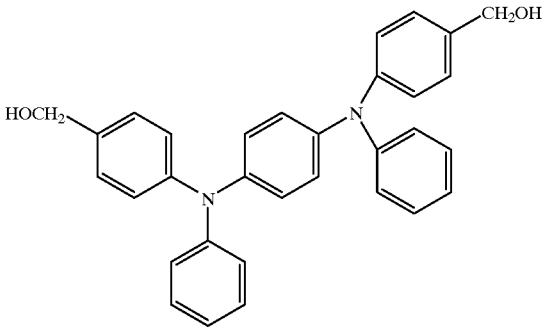
(B-19)
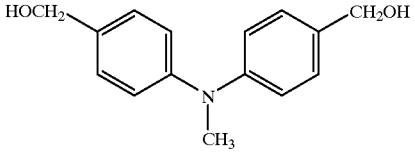
(B-20)
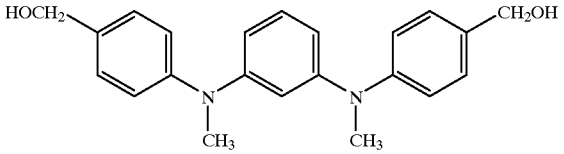
(B-21)
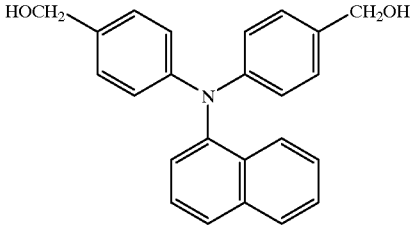
(B-22)
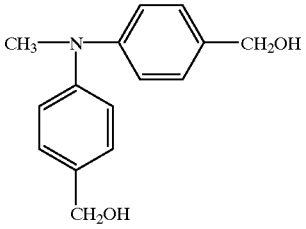

-continued
(B-23)
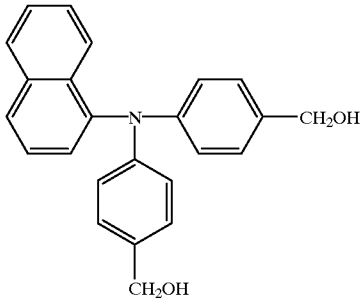
(B-24)
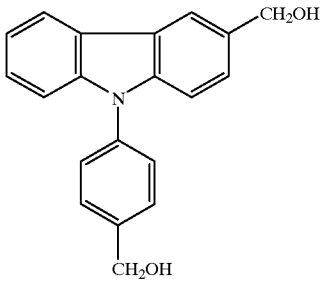
(B-25)
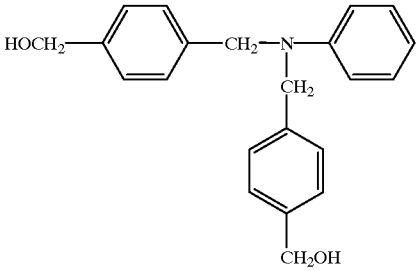
(B-26)
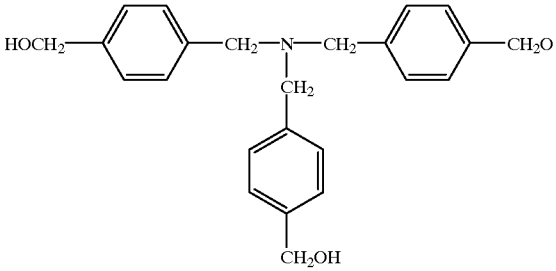
Compounds Z being amino group are listed.
(B-27)
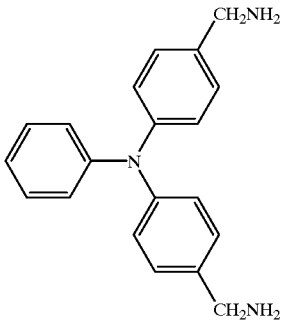
-continued
(B-28)
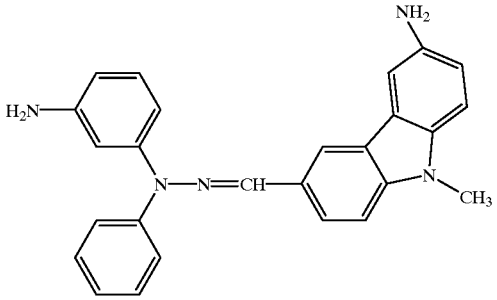

-continued (B-29)

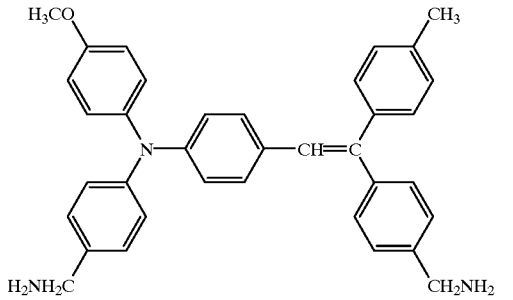

(B-30)

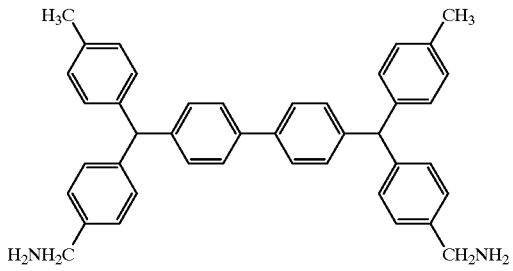

(B-31)

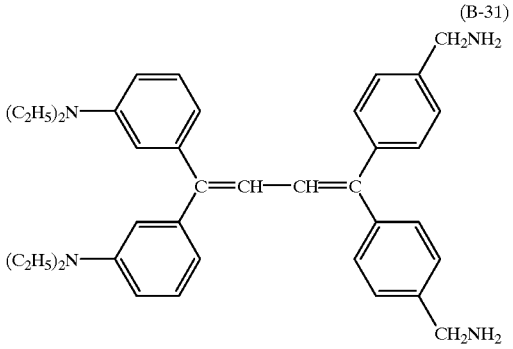

(B-32)

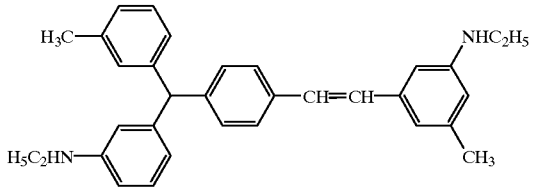

Compounds Z being mercapto group are listed.

(B-33)

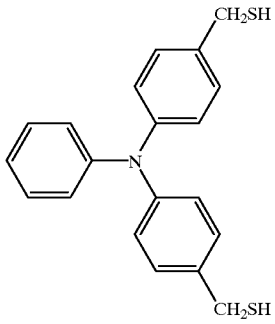

-continued (B-34)

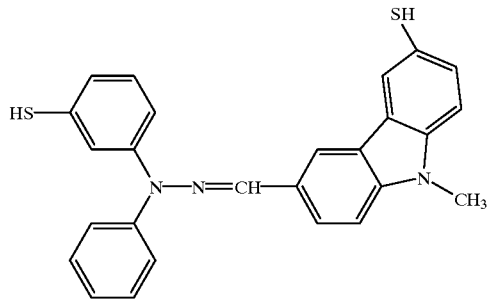

(B-35)

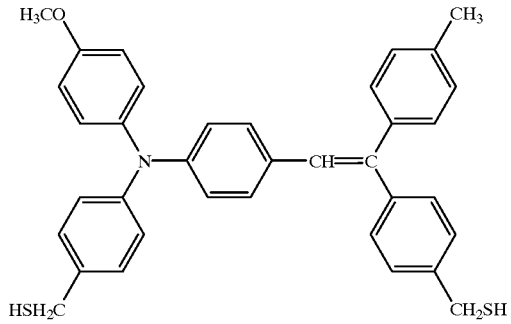

(B-36)

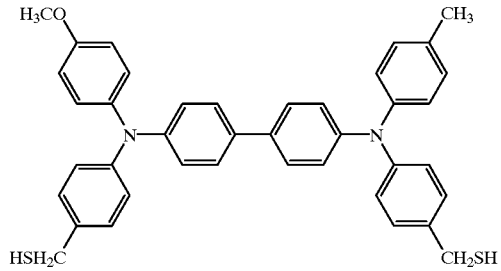

(B-37)

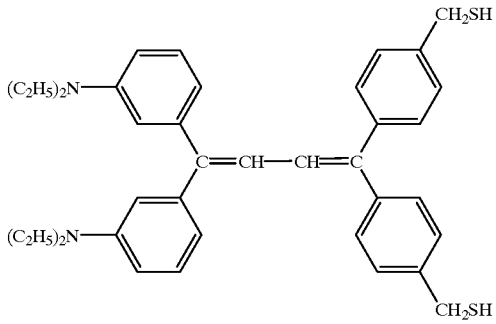

The synthesis example of the above-mentioned compounds will now be briefly described.

Synthesis Example (1)

Synthesis of the Intermediate

Dispersed into 2.5 kg of phosphorus oxychloride was 667.5 g triphenylamine. After heating the resulting dispersion at 85 to 100° C., 1700 ml of dimethylformamide was gradually added dropwise. After dropwise addition, the resulting mixture was heated at 95 to 100° C. for 6 hours while stirring. After finishing reaction, 12 liters of water were added and extraction was carried out employing 6 liters of toluene. The toluene layer was washed well with water.

Added to the resulting extract was 500 g of silica gel (Wakogel BO available from Wako Junyaku) to remove impurities through adsorption. After filtration, toluene was distilled off under reduced pressure to obtain a crude final product. The obtained product was recrystallized employing a solution comprised of acetonitrile and water, in a ratio of 4 to 1 to obtain 465 g of yellow crystals of the intermediate. The resulting intermediate was a mixture of N,N-bis(4-formylphenyl)aniline and 4,4',4"-tris(4-formylphenyl) amine. The analytical result of liquid chromatography showed that the intermediate was the mixture of a dialdehyde body and a trialdehyde body.

Synthesis Example (2)

Synthesis of Exemplified Compounds (B-1) and (B-2)

Dispersed into 675 ml of methanol was 450 g of the above-cited intermediate, and gradually added to the resulting dispersion was 45.0 g (at a mole ratio of 1.1) of sodium boron hydride at room temperature over 3 to 5 hours. The temperature was maintained at no more than 45° C. to compensate for heat generated by reaction. After confirming that the resulting solution was uniform, it was allowed to stand over night. Further, during said reaction, the reaction mixture was shielded as much as possible from light. Added then to the reaction solution were 3.0 liters of water and 180 g of NaCl, and the resulting mixture was extracted employing 3.0 to 3.5 liters of ethyl acetate. The extracted organic layer was washed twice with 3.0 liters of salt water (160 g of NaCl), and lastly with 3.0 liters of water. Ethyl acetate in the mixture was removed by evaporation. After drying, 400 ml of acetonitrile were added and was then removed again by evaporation and ethyl acetate was removed employing azeotropy. Recrystallization was carried out employing 1200 ml of acetonitrile and 358 g of white crystals were obtained (at a yield of 78.7%). The resulting compound was analyzed employing liquid chromatography and was found to be a mixture consisting of 92 percent by weight of the Exemplified Compound (B-1) and 8 percent by weight of the Exemplified Compound (B-2).

Separation of Exemplified Items (B-1) and (B-2)

The above-mentioned intermediate (a mixture consisting of a dialdehyde body and a trialdehyde body) was purified employing a column (developed employing silica gel: toluene/ethyl acetate) and each item of the compounds was obtained. Each item of the compounds was then reduced as described above, and each item Exemplified Compound (B-1) and Exemplified Compound (B-2) was obtained.

Further, regarding the aldehyde formation of aromatic compounds, when the Virzmeier reaction results in low yield, a method is known in which imidazole and trifluoroacetic acid anhydride are employed (refer to Tetrahedron, Vol. 36 (1980) page 2505). Akihiro Ito (Kyoto University) reported at the 1998 Japan Chemical Society Conference that triphenylamine can be subjected to trialdehyde formation employing the same method for a yield of 84 percent.

Synthesis Example (3)

Synthesis of the Intermediate

Dispersed into 500 g of phosphorus oxychloride was 141.2 g of 4-methyltriphenylamine. After heating the resulting dispersion between 75 and 95° C., 317 g of dimethylformamide was gradually added dropwise. After dropwise addition, the resulting mixture was heated at 95 to 100° C. for 6 hours while stirring. After finishing reaction, 3 liters of water was added and extraction was carried out employing 2 liters of toluene. The toluene layer was washed well with water. Added to the resulting extract was 200 g of silica gel (Wakogel BO available from Wako Junyaku) to remove impurities through adsorption. After filtration, toluene was removed under reduced pressure to obtain a crude intermediate product. The obtained product was recrystallized employing a solution comprised of acetonitrile and water in a respective ratio of 4 to 1 to obtain 95 g of yellow crystals of the intermediate. The yield was 54.8 percent.

Synthesis of Exemplified Compound (B-4)

Dispersed into 500 ml of methanol was 63 g of (4-(N,N-bis(4-formylphenyl)amino)toluene) of the above-mentioned intermediate, and gradually added to the resulting dispersion was 6.5 g (at a mole ratio of 1.1) of sodium boron hydride at room temperature over 3 to 5 hours. The temperature was maintained at no more than 45° C. to compensate for any reaction generated heat. After ensuring that the resulting solution was uniform, it was allowed to stand over night. Further, during said reaction, the reaction mixture was shielded as much as possible from light. The reaction solution was concentrated under reduced pressure, and was added with 1.0 liter of water and 20 g of NaCl, and the resulting mixture was extracted employing 1.5 liters of ethyl acetate. The extracted organic layer was washed twice with 1.0 liter of salt water (20 g of NaCl), and lastly with 1.0 liter of water. Ethyl acetate in the mixture was removed by evaporation. After drying, 50 ml of acetonitrile was added and was then removed again by evaporation and ethyl acetate was removed employing azeotropy. Recrystallization was carried out employing 100 ml of acetonitrile, and 51.0 g of white crystals (Exemplified Compound B-4) were obtained (yield of 79%).

As for the layer construction of the photoreceptor, in the negatively chargeable photoreceptor, it is preferable that the resin layer of the invention is applied onto layers provided in the respective order of an undercoating layer (UCL), provided thereon, a function-separated multilayer photoreceptor components comprising a charge generating layer (CGL) and a charge transport layer (CTL) in this order. In the positively chargeable photoreceptor, it is preferable that the layers provided in the order of an undercoating layer (UCL), a charge transport layer (CTL), and a charge generating layer (CGL), (reciprocal to the negatively chargeable photoreceptor, and the resin layer of the invention.

A single layer structure may be employed in which the resin layer of the invention is applied onto a photosensitive layer (charge generation and transport) provided on a u-coat layer (UCL) on an electroconductive support.

The resin layer of the invention serves as the above mentioned photosensitive layer.

Conventional techniques known in the art may be employed to prepare the undercoating layer, the charge generating layer, and the charge transport layer. Listed as charge generating materials (CGM) incorporated into the charge generating layer may be, for example, phthalocyanine pigments, azo pigments, perylene pigments, azulenium pigments, and the like. Listed as charge transport materials incorporated into the charge transport layer (CTL) may be triphenylamine derivatives, hydrazone compounds, styryl compounds, benzidine compounds, butadiene compounds, and the like. These charge transport materials are generally dissolved in suitable binder resins which are employed for formation of a layer.

As for the reasons why the above-mentioned problems (image blurring at high humidity, rise of residual potential during repeated use, and the necessity of a primer layer which increases contrast), the present inventors propose the following postulates:

Namely, aromatic alkyl alcohol compounds represented by the general formula (1) as well as the compounds represented by the general formula (3) exhibit good affinity for the polycarbonate resins employed in the photoreceptor due to the high content ratio of aromatic components or heterocyclic ring components. In addition, because such compounds are alcohol-soluble, they are dissolved in a coating composition for organic silicon compounds (the major component is silanol). It is assumed that after coating, when said coating is heated, the compounds represented by general formulas (1) or (3) react with the above-mentioned organic silicon compounds, having a hydroxyl group or a hydrolyzable group, to form a resin layer comprising a hydrophobic siloxane resin. As a result, it is supposed that the electrophotographic photoreceptor comprising said resin layer on its surface layer maintains a stable surface potential at high humidity to result in marked improvement in image blurring, and because said siloxane resin comprises an aromatic component, sufficient adhesion by the photosensitive layer, comprised of polycarbonate resin and the like, to the lower layer is obtained without the presence of a primer layer.

A layer comprising the siloxane based resin is generally formed by applying a coating composition prepared by dissolving a siloxane based resin composition in a solvent. Employed as such solvents are alcohols and derivatives thereof such as methanol, ethanol, propanol, butanol, methyl cellosolve, ethyl cellosolve, and the like; ketones such as methyl ethyl ketone, acetone, and the like; and esters such as ethyl acetate, butyl acetate, and the like.

The heating and drying conditions for crosslinking and hardening the siloxane based resin vary in response to the types of employed solvents and the presence of catalysts, however, heating is preferably carried out for 10 minutes to 5 hours in case of temperature at about 60 to about 160° C., and is more preferably carried out for 30 minutes to 2 hours in case of temperature at 90 to 120° C.

Furthermore, because, as described above, the electrophotographic photoreceptor is capable of providing the surface resin layer with high hardness, the photoreceptor surface exhibits good abrasion resistance. Such a property exhibits marked advantages for the reversal development process in which the abrasion on the surface of the photoreceptor tends to result in streaks or non-uniformity problems on images.

EXAMPLES

The present invention will now be specifically described with reference to examples. The word "part" as described in these present examples means weight part.

Example 201

A photoreceptor was produced as described below.

A sublayer coating composition was prepared as described below and applied onto an 80 mm diameter aluminum drum-shaped electrically conductive base body so as to obtain a dried layer thickness of 1.0 μm.

<Sublayer>

| | |
|---|---|
| Titanium chelate compound (TC-750, manufactured by Matsumoto Seiyaku Co., Ltd.) | 30 g |
| Silane coupling agent (KBM-503, manufactured by Shin-Etsu Kagaku Co.) | 17 g |
| 2-Propanol | 150 ml |

The photosensitive layer coating composition described below was prepared through dispersion and applied onto the resulting sublayer to obtain a layer thickness of 0.5 μm.

<Charge Generating Layer>

| | |
|---|---|
| Titanyl phthalocyanine (having a maximum peak of 27.3 of X-ray diffraction Bragg angle 2θ using Cu-Kα characteristic X-ray) | 60 g |
| Silicone resin solution (KR 5240, 15% xylene-butanol solution, manufactured by Shin-Etsu Kagaku Co.) | 700 g |
| 2-Butanone | 2000 ml |

were mixed and dispersed for 10 hours employing a sand mill to prepare a charge generating layer coating composition. The resulting coating composition was applied onto the above-mentioned interlayer employing a dip coating method to prepare a 0.2 μm thick charge generating layer.

<Charge Transport Layer>

| | |
|---|---|
| Charge transport material (4-metjhoxy-4'-(4-methyl-β-phenylstyryl)triphenylamine) | 200 g |
| Bisphenol Z-type polycarbonate (Ubiron Z300, manufactured by Mitsubishi Gas Kagaku Co.) | 300 g |
| 1,2-Dichloroethane | 2000 ml |

were mixed and dissolved to prepare a charge transport layer coating composition. The resulting coating composition was applied onto the above-mentioned charge generating layer to form a 25 μm thick charge transport layer.

<Resin Layer>

On the other hand, 490 g of methyltrimethoxysilane and 260 g of dimethyldimethoxysilane were dissolved in 3.0 liters of butanol, and the resulting solution was added to 400 ml of a 3% aqueous acetic acid solution, heated and stirred at 60° C. for 2 hours. After the resulting solution was left at room temperature over night, it was added to 400 g of methanol silica sol (having a concentration of 30 percent, manufactured by Nissan Kagaku), further added with 208 g of exemplified compound (B-1) and 30 g of dibutyl tindilaurylate. The resulting mixture was stirred and dissolved to prepare the coating composition. The resulting coating composition was applied onto the above-mentioned charge transport layer to obtain a dry layer thickness of 1μ and dried at 120° C. for one hour to prepare Photoreceptor 1.

Example 202

Photoreceptor 2 was prepared in the same manner as Example 1, except that the exemplified compound (B-1) in the above-mentioned coating composition was replaced with exemplified compound (B-2).

Example 203

Photoreceptor 3 was prepared in the same manner as Example 201, except that the methanol silica sol in the above-mentioned coating composition was removed.

Examples 24 Through 30

Photoreceptors 24 through 30 were prepared in the same manner as Example 201, except that the mixtures of exemplified compound (B-1) or exemplified compound (B-4) with exemplified compound (B-2), or exemplified compound (B-7) as illustrated in Table 1 below, were employed in place of the exemplified compound (B-1) in Example 201.

TABLE 1

| Photoreceptor No. | Types and Mixing Ratio of Compounds in Combination | |
|---|---|---|
| 4 | Exemplified Compound (B-1): 95 weight parts | Exemplified Compound (B-2): 5 weight parts |
| 5 | Exemplified Compound (B-1): 85 weight parts | Exemplified Compound (B-2): 15 weight parts |
| 6 | Exemplified Compound (B-1): 75 weight parts | Exemplified Compound (B-2): 25 weight parts |
| 7 | Exemplified Compound (B-1): 90 weight parts | Exemplified Compound (B-7): 10 weight parts |
| 8 | Exemplified Compound (B-1): 70 weight parts | Exemplified Compound (B-7): 30 weight parts |
| 9 | Exemplified Compound (B-1): 80 weight parts | Exemplified Compound (B-2): 20 weight parts |
| 10 | Exemplified Compound (B-1): 80 weight parts | Exemplified Compound (B-7): 20 weight parts |

Example 211

Photoreceptor 11 was prepared in the same manner as Example 201, except that the mixture of exemplified compound (B-1) and exemplified compound (B-2) in a ratio of 92 to 8 percent respectively by weight was employed in place of the exemplified compound (B-1) in Example 201.

Example 212

Photoreceptor 12 was prepared in the same manner as Example 211, except that the colloidal silica in Example 211 was removed.

Example 213

Photoreceptor 13 was prepared in the same manner as Example 201, except that exemplified compound (B-32) was employed in place of exemplified compound (B-1) in Example 201.

Example 214

Photoreceptor 14 was prepared in the same manner as Example 201, except that exemplified compound (B-33) was employed in place of exemplified compound (B-1) in Example 201.

Examples 215 Through 221

Photoreceptors 15 through 21 were prepared in the same manner as Example 1, except that exemplified compounds (A-1), (A-5), (A-7), (A-10), (A-13), (A-26) and (A-29) were employed in place of the exemplified compound (B-1) in Example 201.

Example 222

Photoreceptor 18 was prepared in the same manner as Example 215, except that the colloidal silica in Example 215 was removed.

Examples 223 Through 226

Photoreceptors 23 through 26 were prepared in the same manner as Example 215, except that the mixtures of exemplified compound (A-1) or exemplified compound (A-5) with exemplified compound (A-13) as illustrated in Table 2 below were employed in place of the exemplified compound (A-1) in Example 215.

TABLE 2

| Photoreceptor No. | Types and Mixing Ratio of Compounds in Combination | |
|---|---|---|
| 23 | Exemplified Compound (A-1): 95 weight parts | Exemplified Compound (A-13): 5 weight parts |
| 24 | Exemplified Compound (A-1): 85 weight parts | Exemplified Compound (A-13): 15 weight parts |
| 25 | Exemplified Compound (A-5): 90 weight parts | Exemplified Compound (A-13): 10 weight parts |
| 26 | Exemplified Compound (A-5): 80 weight parts | Exemplified Compound (A-13): 20 weight parts |

Comparative Example 201

Photoreceptor 27 was prepared in the same manner as Example 201, except that the exemplified compound (B-1) in the above-mentioned coating composition was replaced with 4,4'-(dimethoxymethyl)triphenylamine.

Comparative Example 202

Photoreceptor 28 was prepared in the same manner as Example 201, except that the exemplified compound (B-1) in the above-mentioned coating composition was removed.

Comparative Example 203

Photoreceptor 29 was prepared in the same manner as Example 201, except that P-1 described below was employed in place the exemplified compound (B-1) in the above-mentioned coating composition.

P-1

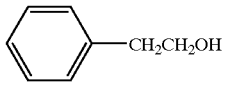

Comparative Example 204

Photoreceptor 30 was prepared in the same manner as Example 1, except that P-2 described below was employed in place of the exemplified compound (B-1) in Example 201, and colloidal silica was removed.

P-2

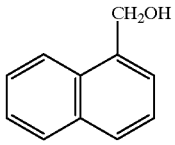

EVALUATIONS

Evaluations were carried out in such a manner that each of the resulting photoreceptors was placed in a Konica 7050 (a digital copier manufactured by Konica Corp., having a negatively charged polarity, and employing reversal development using a 780 nm semiconductor laser beam as a light source), the initial charge potential was set at −650 volts and the exposure amount was adjusted to the sensitivity of each photoreceptors.

At three ambient conditions of 10° C. and a relative humidity 20% (LL), 20° C. and a relative humidity 60% (NN), and 33° C. and a relative humidity 70% (HH), 50,000 prints were subsequently produced under a single sheet intermittent mode, employing an A4 size original image having four equal parts of a letter pattern at a pixel ratio of 7 percent, a portrait image, a solid white image, and a solid black image, so that a total of 150,000 sheets were evaluated. Sampling of image evaluation were carried out at the first print and at every 1000 prints thereafter.

Evaluations were carried out for the image quality of copied images, paying special attention to fogging, image density, blurring, and other image problems, and/or the abrasion on the surface of the photoreceptor and peeling thereof were observed and the decrease in layer thickness of the photoreceptor due to abrasion after the copying test was measured. Table 3 shows the results.

TABLE 3

| Example No. | Photoreceptor No. | Evaluations on Copied Images and Photoreceptor Surface | Decrease in Layer Thickness |
|---|---|---|---|
| Example 201 | 1 | Good images without fogging nor decrease in density of all 150,000 copied images were obtained; abrasion on the photoreceptor surface was not observed. | 0.3 |
| Example 202 | 2 | Good images without fogging nor decrease in density of all 150,000 copied images were obtained; abrasion on the photoreceptor surface was not observed. | 0.3 |
| Example 203 | 3 | Good images without fogging nor decrease in density of all 150,000 copied images were obtained; abrasion on the photoreceptor surface was not observed. | 0.6 |
| Example 204 | 4 | Good images without fogging nor decrease in density of all 150,000 copied images were obtained; abrasion on the photoreceptor surface was not observed. | 0.2 |
| Example 205 | 5 | Good images without fogging nor decrease in density of all 150,000 copied images were obtained; abrasion on the photoreceptor surface was not observed. | 0.2 |
| Example 206 | 6 | Good images without fogging nor decrease in density of all 150,000 copied images were obtained; abrasion on the photoreceptor surface was not observed. | 0.1 |
| Example 207 | 7 | Good images without fogging nor decrease in density of all 150,000 copied images were obtained; abrasion on the photoreceptor surface was not observed. | 0.2 |
| Example 208 | 8 | Good images without fogging nor decrease in density of all 150,000 copied images were obtained; abrasion on the photoreceptor surface was not observed. | 0.2 |
| Example 209 | 9 | Good images without fogging nor decrease in density of all 150,000 ccpied images were obtained; abrasion on the photoreceptor surface was not observed. | 0.2 |
| Example 210 | 10 | Good images without fogging nor decrease in density of all 150,000 copied images were obtained; abrasion on the photoreceptor surface was not observed. | 0.2 |
| Example 211 | 11 | Good images without fogging nor decrease in density of all 150,000 copied images were obtained; abrasion on the photoreceptor surface was not observed. | 0.1 |

TABLE 3-continued

| Example No. | Photoreceptor No. | Evaluations on Copied Images and Photoreceptor Surface | Decrease in Layer Thickness |
|---|---|---|---|
| Example 212 | 12 | Good images without fogging nor decrease in density of all 150,000 copied images were obtained; abrasion on the photoreceptor surface was not observed. | 0.7 |
| Example 213 | 13 | Good images without fogging nor decrease in density of all 150,000 copied images were obtained; abrasion on the photoreceptor surface was not observed. | 0.7 |
| Example 214 | 14 | Good images without fogging nor decrease in density of all 150,000 copied images were obtained; abrasion on the photoreceptor surface was not observed. | 0.6 |
| Example 215 | 15 | Good images without fogging nor decrease in density of all 150,000 copied images were obtained; abrasion on the photoreceptor surface was not observed. | 0.2 |
| Example 216 | 16 | Good images without fogging nor decrease in density of all 150,000 copied images were obtained; abrasion on the photoreceptor surface was not observed. | 0.3 |
| Example 217 | 17 | Good images without fogging nor decrease in density of all 150,000 copied images were obtained; abrasion on the photoreceptor surface was not observed. | 0.3 |
| Example 218 | 18 | Good images without fogging nor decrease in density of all 150,000 copied images were obtained; abrasion on the photoreceptor surface was not observed. | 0.3 |
| Example 219 | 19 | Good images without fogging nor decrease in density of all 150,000 copied images were obtained; abrasion on the photoreceptor surface was not observed. | 0.4 |
| Example 220 | 20 | Good images without fogging nor decrease in density of all 150,000 copied images were obtained; abrasion on the photoreceptor surface was not observed. | 0.6 |
| Example 221 | 21 | Good images without fogging nor decrease in density of all 150,000 copied images were obtained; abrasion on the photoreceptor surface was not observed. | 0.7 |
| Example 222 | 22 | Good images without fogging nor decrease in density of all 150,000 copied images were obtained; abrasion on the photoreceptor surface was not observed. | 0.6 |
| Example 223 | 23 | Good images without fogging nor decrease in density of all 150,000 copied images were obtained; abrasion on the photoreceptor surface was not observed. | 0.2 |
| Example 224 | 24 | Good images without fogging nor decrease in density of all 150,000 copied images were obtained; abrasion on the photoreceptor surface was not observed. | 0.2 |
| Example 225 | 25 | Good images without fogging nor decrease in density of all 150,000 copied images were obtained; abrasion on the photoreceptor surface was not observed. | 0.2 |

TABLE 3-continued

| Example No. | Photo-receptor No. | Evaluations on Copied Images and Photoreceptor Surface | De-crease in Layer Thick-ness |
|---|---|---|---|
| Example 226 | 26 | Good images without fogging nor decrease in density of all 150,000 copied images were obtained; abrasion on the photoreceptor surface was not observed. | 0.2 |
| Comparative Example 201 | 27 | From the initial period, clouding due to non-compatibility between resin phases occurred, and image problenns due to said clouding were observed. | 1.2 |
| Comparative Example 202 | 28 | Decrease in image density and layer peeling were observed under LL ambiance, and image blurring occurred under HH ambiance | 0.4 |
| Comparative Example 203 | 29 | Abrasion was observed on the photoreceptor surface under LL and NN ambiance, and image problenns due to said abrasion were observed. | 1.0 |
| Comparative Example 204 | 30 | Image problems due to abrasion were observed under LL ambiance, and cleaning problems resulted. | 1.2 |

Table 3 suggests that the compounds of the present invention, which are incorporated into a hardened resin layer, not only transport charges but also are subjected to condensation to contribute to the enhancement of strength as well as the improvement in hydrophobicity of the entire layer. It is clear that di- or tri-hydroxy compounds in the Examples result in excellent layer strength compared to the monohydroxy compound in Comparative Example 203.

| Example | Photo-receptor | Initial | | | After 150,000 copies | | |
|---|---|---|---|---|---|---|---|
| | | VH | VL | Vr | VH | VL | Vr |
| 201 | 1 | −650 | −90 | −20 | −660 | −130 | −0 |
| 202 | 2 | −650 | −85 | −20 | −660 | −135 | −65 |
| 203 | 3 | −650 | −90 | −20 | −665 | −125 | −60 |
| 204 | 4 | −650 | −95 | −20 | −660 | −140 | −65 |
| 205 | 5 | −650 | −90 | −20 | −660 | −130 | −60 |
| 206 | 6 | −650 | −90 | −20 | −660 | −135 | −65 |
| 207 | 7 | −650 | −100 | −25 | −665 | −140 | −65 |
| 208 | 8 | −650 | −105 | −25 | −660 | −145 | −65 |
| 209 | 9 | −650 | −90 | −20 | −660 | −130 | −65 |
| 210 | 10 | −650 | −105 | −25 | −660 | −145 | −65 |
| 211 | 11 | −650 | −90 | −20 | −660 | −130 | −60 |
| 212 | 12 | −650 | −95 | −20 | −665 | −135 | −60 |
| 213 | 13 | −650 | −125 | −30 | −675 | −180 | −85 |
| 214 | 14 | −650 | −130 | −30 | −670 | −185 | −85 |
| 215 | 15 | −650 | −125 | −30 | −670 | −170 | −85 |
| 216 | 16 | −650 | −130 | −30 | −675 | −185 | −85 |
| 217 | 17 | −650 | −130 | −30 | −660 | −185 | −85 |
| 218 | 18 | −650 | −125 | −30 | −660 | −175 | −80 |
| 219 | 19 | −650 | −125 | −30 | −665 | −175 | −80 |
| 220 | 20 | −650 | −130 | −30 | −670 | −185 | −85 |
| 221 | 21 | −650 | −135 | −30 | −670 | −180 | −85 |
| 222 | 22 | −650 | −130 | −30 | −670 | −185 | −85 |
| 223 | 23 | −650 | −130 | −30 | −670 | −185 | −85 |
| 224 | 24 | −650 | −135 | −30 | −665 | −185 | −85 |
| 225 | 25 | −650 | −130 | −30 | −670 | −185 | −85 |
| 226 | 26 | −650 | −125 | −30 | −670 | −175 | −80 |
| Cmp. 1 | 27 | −650 | −115 | −25 | −660 | −180 | −60 |
| Cmp. 2 | 28 | −650 | −160 | −65 | −680 | −225 | −130 |
| Cmp. 3 | 29 | −650 | −130 | −30 | −665 | −195 | −80 |
| Cmp. 4 | 30 | −650 | −130 | −30 | −670 | −200 | −80 |

As is clearly illustrated by Examples, the electrophotographic photoreceptor comprising the resin layer of the present invention exhibits markedly excellent surface properties such as sufficient strength, and stable electrical potential under various types of ambient conditions, and still yields excellent images. Namely, in order to prepare images employing the photoreceptor of the present invention, when images are prepared by installing said photoreceptors in an image forming apparatus, markedly excellent images are obtained, and further, the durability of the apparatus itself is enhanced, and the like. Thus, it can be readily assumed that the present invention is suitable for practical applications.

What is claimed is:

1. An electrophotographic photoreceptor comprising a support, a photosensitive layer, and a resin layer obtained by hardening a siloxane resin compound containing a unit represented by formula (1),

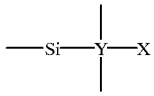

(1)

wherein X is a charge transportability providing group which bonds to Y via a carbon atom which is contained in said providing group, Y represents an at least two valent substituent other than silicon and carbon atoms, and wherein said siloxane resin compound is three-dimensionally cross-linked.

2. The electrophotographic photoreceptor of claim 1 wherein Y is O, S, or NR, and R is H or a univalent organic group.

3. The electrophotographic photoreceptor of claim 1 wherein said resin layer is a surface layer of the electrophotographic photoreceptor.

4. The electrophotographic photoreceptor of claim 3 wherein said photoreceptor has a charge generating layer and a charge transport layer under said surface layer.

5. The electrophotographic photoreceptor of claim 3 wherein the thickness of said surface layer is 0.1 to 20 $\mu$m.

6. The electrophotographic photoreceptor of claim 3 further comprising an adhesive layer under said surface layer.

7. The electrophotographic photoreceptor of claim 1 wherein said photosensitive layer contains at least a charge generating layer.

8. The electrophotographic photoreceptor of claim 1 wherein said support is electrically conductive.

9. The electrophotographic photoreceptor of claim 1 wherein the photoreceptor comprises, in order on said support, an interlayer, a charge generating layer, and a charge transport layer.

10. The electrophotographic photoreceptor of claim 1 wherein said charge transportability providing group is a triarylamine.

11. The electrophotographic photoreceptor of claim 1 wherein said charge transportability providing group is a hydrazine.

12. The electrophotographic photoreceptor of claim 1 wherein said charge transportability providing group is a styryltriphenylamine.

13. The electrophotographic photoreceptor of claim 1 wherein said charge transportability providing group is a benzidine.

14. The electrophotographic photoreceptor of claim 1 wherein said charge transportability providing group is a butadiene.

15. The electrophotographic photoreceptor of claim 1 wherein the electrophotographic photoreceptor is a photoreceptor drum.

16. The electrophotographic photoreceptor of claim 1 wherein said charge transportability providing group contains an alkylene group, and a carbon atom in said alkylene group bonds to Y.

17. The electrophotographic photoreceptor of claim 1 wherein said charge transportability providing group contains arylene group, and a carbon atom in said arylene group bonds to Y.

18. The electrophotographic photoreceptor of claim 1 wherein said charge transportability providing group is monovalent.

19. The electrophotographic photoreceptor of claim 1 wherein said charge transportability providing group is at least divalent and acts as a cross-link group.

20. An image forming apparatus having a charging unit, an image exposure unit, a development unit, and a transferring means, the image forming apparatus further comprising the electrophotographic photoreceptor of claim 1.

21. A process cartridge employed in an image forming apparatus having a charging unit, an image exposure unit, a development unit, and transferring means, the process cartridge comprising the electrophotographic photoreceptor of claim 1 with at least one of the charging unit, image exposure unit, development unit, and transferring means.

22. An electrophotographic photoreceptor comprising a support, photosensitive layer, and a resin layer obtained by hardening a siloxane resin compound by three dimensionally cross-linking by a reaction of an organic silicon compound, having a hydroxyl group or a hydrolizable group, with a charge transport compound having a hydroxyl group.

23. The electrophotographic photoreceptor of claim 22 wherein said hardenable siloxane resin compound bonds three dimensionally by hydrolysis followed by dehydration condensation.

24. The electrophotographic photoreceptor of claim 22 wherein said resin layer is a surface layer of the electrophotographic photoreceptor.

25. The electrophotographic photoreceptor of claim 22 wherein said photosensitive layer comprises a charge generating layer.

26. The electrophotographic photoreceptor of claim 22 wherein the organic silicon compound has at least one hydrolizable group which bonds to a silicon atom.

27. The electrophotographic photoreceptor of claim 26 wherein the organic silicon compound has at least two hydrolizable groups which bond to said silicon atom.

28. An electrophotographic photoreceptor comprising a support, photosensitive layer, and a resin layer obtained by hardening a siloxane resin compound by three dimensionally cross-linking by reacting an organic silicon compound, having a hydroxyl group or a hydrolizable group, with a charge transport compound having an amino group.

29. The electrophotographic photoreceptor of claim 28 wherein said hardenable siloxane resin compound bonds three dimensionally by hydrolysis followed by dehydration condensation.

30. The electrophotographic photoreceptor of claim 28 wherein said resin layer is a surface layer of the electrophotographic photoreceptor.

31. The electrophotographic photoreceptor of claim 28 wherein said photosensitive layer contains a charge generating layer.

32. An electrophotographic photoreceptor comprising a support, photosensitive layer, and a resin layer obtained by hardening a siloxane resin compound by three-dimensionally cross-linking by reacting an organic silicon compound, having a hydroxyl group or a hydrolizable group, with a charge transport compound having a mercapto group.

33. The electrophotographic photoreceptor of claim 32 wherein said hardenable siloxane resin compound bonds three dimensionally by hydrolysis followed by dehydration condensation.

34. The electrophotographic photoreceptor of claim 32 wherein said resin layer is a surface layer of the electrophotographic photoreceptor.

35. The electrophotographic photoreceptor of claim 32 wherein said photosensitive layer comprises a charge generating layer.

36. A method of production of an electrophotographic photoreceptor having a support, a photosensitive layer and a resin layer, comprising (a) coating said support with said resin layer comprising a hardenable siloxane resin prepared by reacting an organic silicone, having a hydroxyl group or a hydrolizable group, with a charge transport compound having a hydroxyl group; and (b) heating to harden said resin layer by three-dimensionally cross-linking at a temperature above 50° C.

37. The method of claim 36 wherein said hardenable siloxane resin compound bonds by hydrolysis followed by dehydration condensation.

38. A method of production of an electrophotographic photoreceptor having a support, a photosensitive layer and a resin layer, comprising (a) coating said support with said resin layer comprising a hardenable siloxane resin prepared by reacting an organic silicone, having a hydroxyl group or a hydrolizable group, with a charge transport compound having an amino group; and (b) heating to harden said resin layer by three-dimensionally cross-linking at a temperature above 50° C.

39. The method of claim 38 wherein said hardenable siloxane resin bonds by hydrolysis followed by dehydration condensation.

40. A method of production of an electrophotographic photoreceptor having a support, a photosensitive layer and a resin layer, comprising (a) coating said support with said resin layer comprising a hardenable siloxane resin prepared by reacting an organic silicone, having a hydroxyl group or a hydrolizable group, with a charge transport compound having a mercapto group; and (b) heating to harden said resin layer by three-dimensionally cross-linking at a temperature above 50° C.

41. The method of claim 40 wherein said hardenable siloxane resin compound bonds by hydrolysis followed by dehydration condensation.

* * * * *

UNITED STATES PATENT AND TRADEMARK OFFICE

CERTIFICATE OF CORRECTION

PATENT NO. : 6,143,452
DATED : November 7, 2000
INVENTOR(S) : T. Sakimura, et al It is certified that error appears in the above-identified patent and that said Letters Patent is hereby corrected as shown below:

Claim 1,
Cancel and structural formula.
Insert --

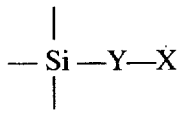

(1) --

Signed and Sealed this

Thirtieth Day of October, 2001

*Attest:*

Nicholas P. Godici

*Attesting Officer*

NICHOLAS P. GODICI
*Acting Director of the United States Patent and Trademark Office*